US010403487B2

(12) United States Patent
Schwieters et al.

(10) Patent No.: US 10,403,487 B2
(45) Date of Patent: Sep. 3, 2019

(54) QUANTITATIVE MEASUREMENTS OF ELEMENTAL AND MOLECULAR SPECIES USING HIGH MASS RESOLUTION MASS SPECTROMETRY

(71) Applicant: Thermo Fisher Scientific (Bremen) GmbH, Bremen (DE)

(72) Inventors: Johannes Schwieters, Ganderkesee (DE); Michael Deerberg, Delmenhorst (DE); Michael Krummen, Bad Zwischenahn (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 587 days.

(21) Appl. No.: 15/235,519

(22) Filed: Aug. 12, 2016

(65) Prior Publication Data

US 2017/0047210 A1 Feb. 16, 2017

(30) Foreign Application Priority Data

Aug. 14, 2015 (GB) ..... 1514471.0

(51) Int. Cl.
*H01J 49/00* (2006.01)
*H01J 49/02* (2006.01)

(52) U.S. Cl.
CPC ..... *H01J 49/025* (2013.01); *H01J 49/0027* (2013.01)

(58) Field of Classification Search
CPC ..... H01J 49/0025; H01J 49/0031; H01J 49/0036; H01J 49/061; H01J 49/067;
(Continued)

(56) References Cited

U.S. PATENT DOCUMENTS

2013/0112868 A1* 5/2013 Schwieters ..... H01J 49/025 250/282
2014/0097338 A1* 4/2014 Eiler ..... H01J 49/0009 250/282

FOREIGN PATENT DOCUMENTS

GB 2483201 B 2/2014
WO 2012007559 A2 1/2012

OTHER PUBLICATIONS

Weyer et al., "High precision Fe isotope measurements with high mass resolution MC-ICPMS," Int. J. Mass Spec., 226, 355-368, 2003.

* cited by examiner

*Primary Examiner* — David E Smith
*Assistant Examiner* — Hsien C Tsai

(57) ABSTRACT

A method for generating a mass spectrum of sample ions using a multi-collector mass spectrometer is disclosed. The mass spectrometer includes a spatially dispersive mass analyser to direct the sample ions into a detector chamber. The method includes generating sample ions of a first ion species A, a second ion species B, and a third ion species C, wherein the ions of species A have a different nominal mass to the ions of species B and C, and further wherein the ions of species B have the same nominal mass as the ions of species C. The sample ions of the species A, B and C are directed to travel through the mass analyser and towards detectors in the detector chamber, the sample ions being deflected during their travel. The ions of species B and C are scanned across a master aperture defined in a master mask of a master detector, while the ions of species A pass through a lead aperture defined in a lead mask of a lead detector. A lead signal is generated representing the ion intensity received at the lead detector from the ions of species A, and generating a master signal representing the ion intensity
(Continued)

received at the master detector whilst the ions of species B and C are scanned across the master aperture. During scanning, ions of the species A are detected by the lead detector while ions of the species B but not C, then both species B and species C, and then species C but not B are detected by the master detector.

40 Claims, 12 Drawing Sheets

(58) Field of Classification Search
CPC .... H01J 49/0086; H01J 49/401; H01J 49/408; H01J 49/421
See application file for complete search history.

QUANTITATIVE MEASUREMENTS OF ELEMENTAL AND MOLECULAR SPECIES USING HIGH MASS RESOLUTION MASS SPECTROMETRY

CROSS-REFERENCE TO RELATED APPLICATION

This application claims the priority benefit under 35 U.S.C. § 119 to British Patent Application No. 1514471.0, filed on Aug. 14, 2015, the disclosure of which is incorporated herein by reference.

FIELD OF THE INVENTION

The invention relates to a method and apparatus for obtaining a high precision mass spectrum recorded in a multi-collector mass spectrometer. The invention further relates to a method for determining isotope ratios and quantitative information of elemental and molecular species from the high precision mass spectrum. The method and apparatus may be of particular benefit for obtaining a mass spectrum of ions having the same nominal mass and so exhibiting a mass interference.

BACKGROUND TO THE INVENTION

Quantitative analysis of elemental and molecular species is a key interest in many fields of science. For instance, accurate and quantitative determination of elemental and molecular species is vital for applications in environmental sciences, as well as for material sciences and life sciences.

A fundamental problem for accurate and precise quantitative mass spectroscopy of molecular and elemental species is the interference of other species contained within the same sample. For example, polyatomic (or molecular) ions in a sample may have the same nominal mass as the atomic (or elemental) isotopes to be analyzed, resulting in a mass interference. In other example, different molecular isotopes may have the same nominal mass. As a result, the contribution of each isotopologue to the measured mass spectrum of the sample may be difficult to resolve.

Although two species may have the same nominal mass, due to the systematic nuclear mass defect, ions will have a true mass that is slightly adjusted from their nominal mass. For example, the mass defect causes polyatomic molecules comprising atoms having a nominal nuclear mass less than iron to appear heavier than elemental species having the same nominal atomic mass. Alternatively, for those polyatomic ions comprised of atoms having a nominal mass greater than iron, the polyatomic ions appear lighter than the elemental species at that atomic mass. Therefore, by obtaining a high enough resolution, the mass peak of each isotope can be resolved.

As described in Weyer et al., *International Journal of Mass Spectroscopy,* 226, (2003), p. 355-368, a double focusing multiple collector inductively coupled plasma (MC-ICP) mass spectrometer can be used to determine isotopic fractions of atomic and polyatomic ions. The detector chamber of the mass spectrometer is equipped with a plurality of Faraday collectors. The Faraday collectors are precisely aligned with respect to atomic and polyatomic ions of the same nominal mass that have been separated at a mass analyzer according to their mass-to-charge ratio. An example of the set-up of one such Faraday collector used in the prior art for measurement of $^{56}Fe$ and $^{40}Ar^{16}O$ is shown in FIG. 1. The Faraday collector 116 comprises an aperture or entrance slit 114 arranged in the pathway of the elemental ions 110 and the molecular ions 112 (the elemental and molecular ions having the same nominal mass and the true mass being separated from each other by virtue of the mass defect). The Faraday collector 116 is precisely positioned with respect to the ion beams such that only the elemental ion species 110 enters the entrance slit 114 of the Faraday collector 116. In contrast, the interfering molecular ions 112 are misaligned with the entrance slit 114 and so prevented from entry to the Faraday collector 116.

By adjusting the parameters at the mass analyzer of the mass spectrometer, the atomic ions and polyatomic ions may be "scanned" across the entrance slit of the Faraday collector. The signal received by the Faraday collector during the change in the deflection of the ion beams results in a mass spectrum or mass scan. The mass spectrum represents the intensity or ion current received into the Faraday collector over the extent of the deflection. As an example, a mass spectrum showing Fe isotopes and their respective molecular interferences is shown at FIG. 2A, with FIG. 2B showing a magnified view of a portion of the same mass scan. The resulting mass spectrum demonstrates a number of sloped and plateau regions. A first sloped region occurs when the atomic ion beam moves into the entrance slit, causing the ion current to increase (region A of FIG. 2A). A plateau region occurs where the full atomic ion beam is received through the entrance slit, and so a maximum intensity of the atomic ion species is recorded (region B of FIG. 2A). A second plateau is observed where both the full atomic and polyatomic ion beams are received in the Faraday collector (region C of FIG. 2A). Finally, a third plateau indicates a region where only the polyatomic ion beam is received through the entrance slit at the Faraday collector (region D of FIG. 2A).

In order to obtain a determination of the isotopic ratios present in the sample, Weyer et al. compare the isotopic ratios at different points on the first plateau of the mass spectrum. The diamonds shown in FIG. 2B are $^{56}Fe/^{54}Fe$ isotopic ratios (see right side y-axis) measured at the marked positions on the plateau. It can be seen that the three data points at the center part of the plateau are in good agreement with each other (within error). However, those data points at the edges of the plateau appear to provide an anomalous result for the isotopic ratio.

Accordingly, the known method of determining isotopic ratios described in Weyer et al. requires broad and flat plateaus in the mass spectrum to provide accurate and consistent measurements. The provision of suitable plateau in samples having ions demonstrating mass interferences relies on a very high resolution separation of the ion species. Furthermore, where temperature fluctuations and mechanical or electrical instabilities occur at the mass spectrometer, these effects can cause drift in the peak position over the measurement time, resulting in inaccuracies in the estimated values.

The mass resolving power can be improved in sector field mass spectrometers by reducing the width of the entrance slit of the Faraday collector. However, this also reduces that overall transmission of ions through the slit, and thereby reduces sensitivity. Increased mass resolving power comes at the cost of ion beam transmission and therefore cannot be increased without limits.

Further limitations of the peak plateau technique described above are apparent in the presence of three mass-interfering ion species. In this circumstance, the ion species with the middle atomic mass does not demonstrate a clean plateau at which a representative signal, independent of the high and low mass ion species, can be identified. Further improving mass resolution by selecting smaller source slits is not feasible because of the significant loss of transmission and ion beam intensity at the detector.

As such, there is required an improved technique for providing high precision quantitative measurements of elemental and molecular species using high resolution mass spectroscopy.

SUMMARY OF THE INVENTION

Against this background, there is provided a method and apparatus for obtaining a mass spectrum of mass interfered ions in a mass spectrometer comprising multiple detectors. The mass interfered ions may be atomic or molecular species having the same nominal mass. The method provides a normalized mass spectrum having particularly high precision and an improved clarity of plateau features resulting from the mass interference. The method also results in a mass spectrum which is less affected by intensity fluctuations of the ion beam, which may occur over the duration of the measurement. The improved mass spectrum may be used to determine the abundances and isotope ratio of species within a sample, and is particularly useful within a deconvolution method to resolve the peak shape of the mass-interfering ion species.

A mass spectrum of sample ions is obtained using a mass spectrometer having a plurality of detectors. The detectors may be of any type known for use in multi-collector mass spectrometers. Such detectors are preferably Faraday detectors (also known as Faraday cups or Faraday collectors), or ion counters, including for example electron multipliers (e.g. discrete dynode electron multipliers and/or continuous dynode electron multipliers), or other types, or any combination of these e.g. a combination of Faraday detectors and electron multipliers. Although the description of the invention may generally refer to Faraday detectors as the type of detectors used within the invention, it should be understood that the Faraday detectors may be replaced by any of the other types of detector. Any type of detector that is used has an entrance slit or entrance aperture.

The detectors are arranged in a detector chamber of the mass spectrometer. Sample ions are passed from a spatially dispersive mass analyzer to the detector chamber, and the ions are received by the detectors. In the mass analyzer the sample ions are deflected, with the magnitude of deflection dependent on the ion mass-to-charge ratio. This results in the ions entering the detector chamber being spatially separated from each other according to their mass.

In the method described herein, at least ions of a first species, ions of a second species and ions of a third species are projected from the mass analyzer into the detector chamber. The ions of the first species have a different nominal mass compared to the ions of the second and third species, and the ions of the second species have the same nominal mass as the ions of the third species. In view of this, the ions of the first species are separated from the ions of the second and third species in the mass spectrum, but the ions of the second and third species are mass interfered and separated in the mass spectrum only by the mass defect.

Within the detector chamber, the ions of the first species are received at a lead detector. At the entrance to the lead detector is a lead aperture or lead entrance slit through which the ions must pass to be detected by the lead detector. The ions of the second and third species are received at a master detector, which has a master aperture or master entrance slit through which ions must pass to be detected by the master detector. The lead entrance slit of the lead detector (having a first width) may be wider than the master entrance slit of the master detector (having a second width) in some examples, although this is not necessary in every embodiment of the invention. In one embodiment the lead entrance slit and the master entrance slit can have the same width.

At the lead and master detector, an ion intensity or ion current is measured while the deflection or direction of the ions of at least the second and third species is varied or "scanned" at the master detector. For example, a change or variance in the deflection or direction of all the sample ions may be produced by ramping or changing the magnetic field within the mass analyzer. In another example, only the second and third ions may be scanned by use of an ion deflection unit placed downstream of the mass analyzer (and before the master aperture). In other examples, the electric field in an electrostatic sector of a mass analyzer could be ramped, or the ion energy of the sample ions could be scanned. Varying each of these parameters at the mass spectrometer causes a change in deflection of the ions. The described methods for the deflection of the ions could be used separately or in combination. In an alternative example, the ions of the second and third species may be scanned at the master detector by movement of the entrance slit relative to the "beam" of ions. In further examples, a combination of the described method of deflection may be used in combination with movement of the master detector (for instance, by changing the magnification or dispersion of the instrument using a zoom lens).

As a result of a change in deflection of the ions (or the movement of the master entrance slit), the position at which ions of the second and third species are incident at the master detector is scanned or displaced across the entrance slit. A signal is then generated at the master detector which is proportional to the intensity of the ions of the second and third species entering the master detector during the change in the direction. This represents the mass spectrum of the mass-interfered ions. Similarly, a signal is generated at the lead detector which is proportional to the intensity of the ions of the first species entering the lead detector during the period during which the second and third species of ions are scanned. Ideally, a maximum ion intensity of the first species will be received at the lead detector throughout the scan of the second and third ions (in other words, for the whole width of the period of interest of the mass spectrum of the mass interfered ions).

The signal received from the master detector may then be normalized using the signal received from the lead detector. This provides a normalized mass spectrum of ions of the second and third species (in other words, a normalized mass interfered mass spectrum). As the different ion species are generated at a common ion source, any signal fluctuation is assumed to be similar for each ion species (or ion current). Recording the intensity of the first ion species for the situation where all ions of the first species (i.e. maximum intensity) are collected by the lead detector while the position of the second and third species is varied at the master detector means that the lead detector signal reflects the fluctuations inside the ion source. Therefore, the normalized mass spectrum for the second and third species, which is normalized by reference to the lead detector signal from the first ion species, is substantially independent of signal fluctuations or signal drifts. When recording the signals over considerable periods of time, e.g. over many scans, where signal fluctuations would otherwise significantly affect the detected peak shapes and intensities, the normalization approach leads to much improved peak shape precision. The use of the lead detector is therefore to generate a signal which can be used for normalization of the second and third signals. Ideally the signal measured on the lead detector is perfectly flat and does not show any structure due to peak overlays of different ion species.

This limitation is completely avoided in cases where the ion beam position of the first ion species is stable (i.e. the ion beam position for the first species is not changed at the lead detector) while the species falling on the master detector are scanned across the master detector aperture to capture the full structure of the interfered peak. Referencing of the master detector signals to the lead detector always guarantees normalization and cancelling of drift effects which otherwise would distort the peak shape on the master detector.

According to the invention, the lead detector is aligned such that the ions of the first species enter through the entrance slit of the lead detector throughout the scan of the second and third ion species. As such, the extent of the variation of the deflection (or displacement) of the ions of the first species at the lead detector is less than the width of the lead entrance slit. In most preferred embodiments, the position of the beam of the ions of the first species at the lead detector is not changed while scanning the second and third ion species at the master detector. In some alternative embodiments, the lead detector is arranged such that the first ions are deflected across the entrance slit of the lead detector during the variation of the deflection (or displacement) of the second and third ions. Accordingly, the displacement of the second and third ion beams at the master detector is greater than the width of the entrance slit to the master detector. In some other embodiments, the second and third ion species could be scanned at the master aperture and detector by moving the master aperture and optionally master detector.

The mass spectrum measured at the lead detector preferably is always a maximum intensity during all or almost all the scan or deflection of the second and third ion beams. The maximum lead signal is generated when the full ion beam of the first ion species is received into the lead detector through the lead entrance slit, throughout the deflection or scanning of the second and third ion species. However, the mass spectrum measured at the master detector demonstrates slopes and plateaus according to the change in the ion intensity as the mass peaks of the ions of the second and third species move across the entrance slit of the master detector. This means that after normalization of the signal recorded at the master detector with the signal recorded at the lead detector, any small fluctuations in the intensity of the original, unseparated ion beam can be eliminated. Accordingly, the complex peak shape of the signal recorded at the master detectors can be measured to very high precision. Small artefacts can be identified, for instance due to scattering events and small peaktailing effects occurring when the ion beam enters the slit of the master detector.

According to a first aspect of the invention, there is provided a method for generating a mass spectrum of sample ions using a multi-collector mass spectrometer, the mass spectrometer comprising a spatially dispersive mass analyzer to direct the sample ions into a detector chamber, the method comprising:

(a) generating sample ions of a first ion species A having a mass to charge ratio $(m/z)_A$, a second ion species B having a mass to charge ratio $(m/z)_B$, and a third ion species C having a mass to charge ratio $(m/z)_C$, wherein the ions of species A have a different nominal mass to the ions of species B and C, and further wherein the ions of species B have the same nominal mass as the ions of species C;

(b) directing the sample ions of the species A, B and C to travel through the mass analyzer and towards detectors in the detector chamber, the sample ions being deflected during their travel;

(c) scanning the ions of species B and C across a master aperture defined in a master mask of a master detector, while the ions of species A pass through a lead aperture defined in a lead mask of a lead detector; and (d) generating a lead signal representing the ion intensity received at the lead detector from the ions of species A, and generating a master signal representing the ion intensity received at the master detector, while the ions of species B and C are scanned across the master aperture;

wherein during scanning, ions of the species A are detected by the lead detector while ions of the species B but not C, then both species B and species C, and then species C but not B are detected by the master detector.

Preferably, the method further comprises:

(e) normalizing the master signal from the ions B and the ions C using the lead signal to determine a normalized mass spectrum of the ions B and the ions C. In this embodiment, the master signal is calibrated by reference to the lead signal (which reflects signal fluctuations) to determine the normalized mass spectrum of the ions B and the ions C. Thus, when the master signal is being recorded over a long time, or over many scans, signal fluctuations are accounted for and a more precise peak shape is obtained. This in turn allows for better deconvolution of the peaks and therefore better determination of ion abundances.

The mass spectrometer may be a double-focusing mass spectrometer, although the method can also be applied within a single focusing mass spectrometer. Preferably, the mass spectrometer comprises a plurality of detectors within the detector chamber. The detector chamber may comprise Faraday detectors or other types of detector such as ion counting detectors, for example electron multipliers or conductivity detectors (such as a controlled drift detector, CDD). In a particular example, the lead detector is a lead Faraday detector which is one of a number of moveable Faraday detectors, and the master detector is a master Faraday detector which is a fixed, center Faraday detector.

The mask or entrance plate for each detector may be integral to the detector, or maybe a separate part. For example, the mask may be spaced apart from the remaining portion of the detector, or may form a panel or wall of the detector. In either case, the mask is arranged in the path of the ion beam, between the entrance to the detector chamber and the sensing portion of the detector. Ions received at the detector are incident to the mask and enter through the aperture or entrance slit formed in the mask.

The aperture may be a slit or opening defined in a mask at the entrance to the detectors. The size of the aperture describes the dimension of the slit or opening in the direction in which the ions are scanned or deflected, for example the slit width. Normalizing the master signal to the lead signal to obtain a normalized mass spectrum may comprise adjusting the scale of the master signal to a scale in common with the lead signal. For example, the scale of the master signal may be adjusted in view of the maximum and minimum values of the lead signal. The adjustment or normalization of the master signal by the lead signal may be performed by dividing every data point at master signal at a given point in time by the lead signal acquired at the same point in time. In a particular example, the normalization may be relative to a standard point in the lead signal, such that every data point of the master signal is scaled in comparison to the standard point.

Advantageously, the obtained normalized mass spectrum provides a very precise peak shape. The described method is especially beneficial to reduce the effects of intensity fluctuations or drifts in the ion beam intensity over time (for example, due to an electrical or mechanical drift, or due to changes in temperature).

The nominal mass of the ions of species A, the ions of species B and the ions of species C is the mass that would be expected according to the number of protons and neutrons present in the nuclei of an ion of the given species. In elemental or atomic ions, the nominal mass should be representative of the true atomic mass. However, in molecular or polyatomic ions the true molecular mass is adjusted compared to the nominal mass by the mass defect. The mass defect results from the equivalence of mass and energy, and denotes the alteration in mass representative of the nuclear binding energy.

Adjusting the scanning ion species B and C may comprise adjusting the parameters of the mass analyzer to change the deflection of the ions travelling there through. For example, the magnetic field at the mass analyzer may be scanned or ramped. This has the effect of varying the deflection of the ions of species A, the ions of species B and the ions of species C. Each species of ion is deflected at an angle determined by its mass-to-charge ratio during its passage through the mass analyzer. This results in the ions being spatially separated into "ion beams" of each species of ion. The extent to which the ions are deflected can be adjusted by changing the applied magnetic field in the mass analyzer. As the same magnetic field is simultaneously applied to all ions passing through the mass analyzer, any adjustment in the parameters of the mass analyzer will cause the deflection or direction of all the species of ions will be changed simultaneously.

Other methods and techniques may be used for scanning of ion species B and C. These are described in full detail below. In one example, the mass analyzer may comprise an electrostatic sector within a double focusing mass spectrometer, and the deflection or change in direction of the ion beams may be proportional to the electric field applied to the electrostatic sector. Therefore, the ions may be scanned by adjusting or ramping the electric field at the electrostatic analyzer, preferably while keeping the magnetic field constant. In a further example, the deflection of the sample ions is adjusted by scanning or ramping the energy of the sample ions. In another embodiment the ions may be scanned by adjusting in parallel the electric field at the electrostatic analyzer and the energy of the ions. In a preferred embodiment the parallel adjustment of the electric field and the energy of the ions is executed with a fixed ratio. Alternatively, the deflection of particular species of ion (or ion beams) can be adjusted by using a pre-aperture deflection unit downstream of the mass analyzer. For example, a master pre-aperture deflection unit may be used in front of the master aperture to particularly vary a deflection of ions species B and C, thereby causing the ion species B and C to be scanned across the master aperture while the position of ions species A is kept constant in the lead detector.

Optionally, in one type of embodiment, while the ions of species B and C are scanned across the master aperture, the method further comprises scanning the ion species A across at least a portion of the lead aperture of the lead mask of the lead detector. In other words, the ions of species A may be scanned simultaneously with the ions of species B and C. For example, parameters of the mass analyzer may be adjusted (to vary magnetic or electric field) and so cause a change in the deflection of all sample ions concurrently. In one example in which the deflection of the ions of species A is adjusted, the configuration of the lead aperture, master aperture and the extent of the deflection of the ion species A, B and C is such that ions of the species A are passing through the lead aperture and are collected by the lead detector throughout the period during which ions of the species B but not C, then both species B and species C, and then species C but not B are detected by the master detector. Advantageously, this provides a maximum current at the lead detector throughout the period of deflection, which can then be used to normalize the mass spectrum measured at the master detector.

Beneficially, the lead aperture is wider than the master aperture. This configuration may be particularly advantageous when both the ions of species A as well as the ions of species B and C are scanned. Providing a lead aperture that is relatively larger or wider than the master aperture may be useful to provide a maximum ion intensity of ions of species A at the lead detector throughout the period of scanning or adjustment of the deflection of ions of species B and C. This is because the ions of species A will be able to pass through the lead aperture throughout the scan or deflection, and will not be blocked by the lead mask. However, in some examples the lead aperture and the master aperture may be the same size or width, or the lead aperture may be smaller than the master aperture. For example, where the ions of species B and C are scanned but the ions of species A are not, the lead aperture may be narrower than the master aperture. This scan or adjusting of the deflection of ions of species B and C but not species A may be achieved, for example, using a pre-aperture deflector positioned downstream of the mass analyzer and in front of the master detector as described further below.

Preferably, scanning the ions of species B and C comprises adjusting the deflection of ions of species B and C during their travel through the mass analyzer and towards detectors in the detector chamber. In other words, scanning the ions of species B and C (and in some examples, also scanning the ions of species A) may be achieved by changing the deflection applied to the ions as they travel through the mass analyzer and towards the detectors at the detector chamber. For example, this may involve changing the deflection applied within the mass analyzer, or could comprise application of an additional deflection prior to entrance to the detector (for instance, by using a pre-aperture deflection unit before the aperture at the entrance to a detector).

Optionally, scanning the ions may comprise movement of the beam of ions relative to an entrance aperture at the entrance to a detector. For example, scanning the ion of species B and C may comprise movement of the ion beam relative to the master aperture. Movement of the ion beam may be accomplished either by changing the deflection of the ion beam so as to scan across the aperture, or by movement of the aperture relative to the stationary ion beam. In both cases, the effect of the relative movement is to cause the ions to be passed across the aperture so that the ion beam is first blocked by the aperture, then passes through the aperture, and is then blocked by the aperture.

Optionally, where scanning by adjusting the deflection by the mass analyzer is employed, scanning comprises ramping the magnetic field at the mass analyzer. Applying a magnetic field to sample ions at the mass analyzer causes ion species having different mass-to-charge ratios to spatially disperse. Varying or ramping the applied magnetic field causes the extent of deflection (or the change of angle of the ion beams) to by adjusted. Accordingly, at an aperture plate at the entrance to a detector (such as at the lead mask or the master mask) the ion beam moves across the aperture as the extent of the deflection is changed. Applying a magnetic field affects all the sample ions passing through the magnetic analyzer. Therefore, the deflection of ions of species A and the ions of species B and C would both be adjusted as a result of ramping the magnetic field at the mass analyzer. Advantageously, ramping the magnetic field provides an easily controllable method for adjusting the deflection of the ions.

Optionally, where scanning by adjusting the deflection by the mass analyzer is employed and a double-focusing mass analyzer is used, scanning comprises scanning the electric field at an electrostatic sector of the mass analyzer. Preferably, the magnetic field at the mass analyzer is kept constant. In a similar manner to an application of a magnetic field in a mass analyzer, ramping an electric field at the electrostatic sector of a mass analyzer causes the extent of deflection (or the change of angle of the ion beams) to be adjusted. The ramping of an electric field will affect all sample ions, and so the deflection of each of ion species A, B and C will be adjusted. Adjusting the deflection causes the movement of the ion beam incident to the aperture plate, relative to the aperture. Ramping the electric field provides a straightforward method for control of the deflection of the sample ions at an electrostatic sector of the mass analyzer.

Optionally, e.g. where scanning or adjusting the deflection of all ions beams (for species A, B and C) is employed, adjusting the deflection comprises scanning an energy of the sample ions. The extent of deflection of sample ions in the mass analyzer is dependent on the energy of the ions. Increasing or ramping the energy of the sample ions (for example, by acceleration of the ions in the mass spectrometer) therefore adjusts the amount by which the ions are deflected in the mass analyzer, and causes the ion beam to be scanned relative to an aperture at the detector. Scanning or varying the energy of the sample ions may adjust the deflection of ions of species A, B and C simultaneously.

Preferably, scanning comprises ramping or adjusting a deflection provided by an ion deflection unit downstream of the mass analyzer. In other words, an ion deflection unit may be placed in the path of ions of a particular species after the ions have exited the mass analyzer and prior to an aperture or entrance slit to a detector. The ion deflection unit (or pre-aperture ion deflection unit) can then be used to deflect only some of the species of the sample ions. Further information on a pre-aperture ion deflection unit of this type may be found in patent publication WO 2012/007559 by the present Applicant and which is incorporated by reference herein in its entirety. In a particular example, the ion species B and C may be scanned across the master aperture by changing a deflection caused by a master pre-aperture deflection unit located downstream of the mass analyzer and in front of the master aperture. In this case, the pre-aperture ion deflection unit may be arranged downstream of the mass analyzer and in the pathway of ions of species B and C, prior to the master aperture. The ion deflection unit can then be used to further deflect (in other words to adjust the overall deflection) of ions of species B and C. In this way, the ions of species B and C can be scanned across the master aperture, while the deflection of the ions of species A remains unchanged. Beneficially, as ions of species A are not scanned or further deflected, these ions can be precisely aligned to pass through the lead aperture throughout the period of deflection of ions B and C. A narrower lead aperture may therefore be used, and a suitable configuration of the lead aperture, master aperture and the change in deflection of ions of species B and C may more easily be attained.

This use of the pre-aperture deflection unit for the master detector provides a further significant technical advantage. An important aspect of employing the pre-aperture deflection unit in front of the master detector (and not adjusting the deflection of the ion beam at the lead detector) is that the lead detector signal therefore corresponds to a fixed ion beam position and ion mass so that there is even no need for the lead detector signal to be free of interferences. The reason for the lead detector is to generate a signal which can be used for normalization of the B and C master detector signals. This requires that the lead detector signal from ion species A always reflects the fluctuations inside the ion source and this signal therefore should ideally not be complicated by a peak structure that includes effects of interference of different ion species in the lead detector signal by scanning the species at the lead detector. Ideally the signal measured on the lead detector is perfectly flat and does not show any structure due to peak overlaps of different ion species. This limitation is completely avoided in embodiments where the ion beam position of the ion species A is stable while the species B and C falling on the master detector are scanned across the master detector aperture to capture the full structure of the interfered B and C peak. Referencing of the master detector signals to the lead detector signals always guarantees normalization and cancelling of signal drift effects which otherwise would distort the peak shape on the master detector.

In an alternative embodiment, a lead pre-aperture deflection unit located downstream of the mass analyzer and in front of the lead aperture deflects the ion species A such that the ion species A fully passes through the lead aperture while the ions of species B and C are scanned across the master aperture. For instance, the ion species B and C can be scanned across the master aperture and detector by adjusting the deflection caused by the mass analyzer (according to any of the methods described above) or by adjusting the beam energy, and the beam of ion species A can be kept substantially fixed in position at the lead aperture by compensating the deflection of ion species A caused by the mass analyzer or beam energy change, the compensation being performed by a pre-aperture deflector positioned in front of the lead aperture and detector. In another alternative, compensating the deflection of ion species A caused by the mass analyzer can be achieved by moving the position of the lead aperture/detector so that ion species A can be kept substantially fixed in position to the lead aperture.

In another type of embodiment, the ion species B and C can be scanned across the master aperture by moving the master aperture and optionally the master detector, while the deflection by the mass analyzer is not changed. In this case, the ion species A can be kept substantially fixed in position to the lead aperture.

Preferably, for all times when at least one of the ion species B and C is being collected by the master detector, ions of the species A are passing through the lead aperture and are collected by the lead detector. In other words, the lead detector may be arranged such that the full beam of ions of species A passes through the aperture throughout the period of the scan. In contrast, the beam for ions of species B and of species C may be arranged such that in a first position the ion beams are blocked by the master mask at one side of the master aperture. Both ion beams may then be deflected or scanned across the master aperture, until they reach a second position at the opposite side of the master aperture to the first position. At the second position, the ions of species B and of species C are blocked from entry to the master detector by the master mask. As the ions are scanned between the first and second position, the ions of the second species B first enter the master detector through the master aperture alone, then both the second and third species enter, and then only the third species enter the master detector. Beneficially, this provides a mass spectrum for the ions of species B and of species C to be obtained at the master detector, while simultaneously a signal of maximum intensity is received at the lead detector. The magnitude of scan or displacement of the ions, the alignment of the lead and master detector, as well as the width of the lead and master apertures must be appropriately chosen for provision of a master signal and lead signal having the desired characteristics for normalization. These variables will be dependent on the sample isotopes to be measured, as well as the characteristics of the mass spectrometer and the method of scanning or adjusting the deflection of the ions.

Preferably, in order to obtain the lead signal and master signal described above, in embodiments where the deflection of all ion species are changed, the distance between the first and second position of ions of species A at the lead mask is less than the width of the lead aperture. In addition, the distance between the first and second position of the ions of species B and the distance between the first and second position of the ions of species C at the master mask are both greater than the width of the master aperture.

Optionally, the ions of species A comprise a first species of atomic isotope, the ions of species B comprise a second species of atomic isotope and the ions of species C comprise a species of molecular isotope. For instance, ions of species A and of species B may be different isotopes of the same element, and the ions of species C may comprise an isotope of a molecule. As an illustrative example, the ions of species A may be $^{56}Fe^{+}$, the ions of species B may be $^{57}Fe^{+}$, and the ions of species C may be $^{40}Ar^{16}OH^{+}$.

Alternatively, the ions of species A comprise a first species of molecular isotope, the ions of species B comprise a second species of molecular isotope and the ions of species C comprise a third species of molecular isotope. For instance, ions of species A, ions of species B and ions of species C may be different isotopes of the same molecule, typically where ion species A is the most abundant molecular isotope. As an illustrative example, the molecule may be methane and the ions of species A may be $^{12}CH_4^{+}$, the ions of species B may be $^{13}CH_4^{+}$, and the ions of species C may be $^{12}CH_3D^{+}$.

It will be understood that any number of further ion species may also be present in the ion beam and be detected. For example, there may be one or more further ion species that mass interfere with the second ion species B and third ion species C (e.g. a fourth species D, and so on). In this way, there may be three, four, five or more interfering ion species detected by the master detector (or master Faraday detector).

Advantageously, the method further comprises positioning the lead detector within the detector chamber to receive the ions of species A. The lead detector may be a moveable detector within the detector chamber. The position of the detector may be adjusted relative to the ion beam of the ions species of interest, in order to provide the correct alignment for successful application of the method (i.e. so that the ions of species A are incident towards the lead detector). The moveable detector may be motorized, with the positioning of the detector being computer or manually controlled to allow repositioning of the detector from outside the detector chamber. Alternatively, the lead detector could be a fixed detector.

Optionally, the method further comprises positioning the master detector within the detector chamber to receive the ions of species B and the ions of species C. The lead detector may be a moveable detector within the detector chamber. The position of the detector may be adjusted relative to the ion beam of the ions species of interest, in order to provide the correct alignment for successful application of the method (i.e. so that the ions of species B and C are incident towards the master detector). The moveable detector may be motorized, with the positioning of the detector being computer or manually controlled to allow repositioning of the detector from outside the detector chamber.

Alternatively, the master detector may be a fixed detector or fixed Faraday cup. For instance, the master detector may be the fixed, center detector within a plurality of detectors arranged in a plane in the detector chamber to receive sample ions.

In certain embodiments, both the lead detector and the master detector may be positioned as described, i.e. may be moveable within the detector chamber.

Optionally, the mass spectrometer comprises a plurality of detectors in the detector chamber, each detector comprising a mask defining an aperture. Preferably, the aperture size of each of the plurality of detectors is not all the same. The lead detector and/or the master detector may be designated from amongst a plurality of detectors to select the size or width of the said lead and/or master aperture. For example, the lead and/or master detector may be selected in view of their alignment with the ion species of interest, and in view of the size of the aperture relative to the displacement of the ion beam during the scan of the ions. Beneficially, this allows a greater flexibility in the configuration and arrangement of the mass spectrometer, and an increased choice of the variables available for successful implementation of the method of the invention. For example, it allows the mass spectrometer to be configured to measure a specific species of sample ion.

Alternatively, optics (or specifically zoom optics) may be configured in order to align the ion species (or ion beam) of interest with the entrance aperture of the master or lead detectors. This allows good alignment of the ion species with the appropriate detector for successful implementation of the method. Use of zoom optics can give appropriate alignment without requiring movement (or requiring less movement) of the detectors relative to each other.

Optionally, determining a normalized mass spectrum of the ions B and the ions C comprises dividing the master signal at a given point in time by the lead signal acquired at the same point in time. This type of "point wise" normalization may be especially useful when only one master signal trace is acquired, as fluctuations specifically within the ion beam at the time of the trace may be effectively eliminated.

Preferably, the normalized mass spectrum of the ions of species B and ions of species C is a first normalized mass spectrum. A second or further mass spectrum may then be obtained by applying the same method as described above. Consequently, an average of the first and second normalized mass spectrum can be calculated to determine an average normalized mass spectrum. For instance, the average of the ion intensity of the first and second normalized mass spectrum at each value of the mass deviation (or scan of the ions) may be calculated. Beneficially, this average provides a normalized mass spectrum with increased precision, and is especially useful to reduce the effects of anomalous data points in the measured mass spectrum and to improve statistics.

Advantageously, the average normalized mass spectrum described above can be denoted a former average mass spectrum. A further, or new, normalized mass spectrum may then be obtained by repeating the method steps described above. A new average normalized mass spectrum may then be determined from an average of the new normalized mass spectrum and the former, previous average normalized mass spectrum. This process can be repeated many times, each time in order to "overlay" newly measured normalized mass spectrum over the average established from previous measurements.

The scan direction or scan speed may be varied between multiple acquisitions and the various scans to be added or averaged may be aligned and stretched to produce optimal results. This alignment and stretch technique may make use of techniques known in gas and liquid chromatography.

In some cases, data points in the newly measured mass spectrum could be discarded if determined to be outside of a predetermined range or set of boundaries (for example, outside of an error bound), e.g. by reference to the average established from previous measurements. Use of this technique allows small drifts of the mass peak positions and small instability spikes in the ion intensity (for example, as a result of high voltage spikes) to be effectively eliminated.

As an alternative, an average of a set of measured normalized mass spectra may be obtained. In a further alternative, a best-fit normalized mass spectrum may be obtained from a plurality of measured normalized mass spectra by applying statistical techniques such as least-squares regression.

In one embodiment, multiple normalized mass spectra (i.e. peak scans) may be obtained. Before averaging the mass spectra, each new spectrum is compared with the average of the previous mass spectrum. The new mass spectrum is then fitted to the average spectra using known statistical techniques for compensation of a mass deviation due to magnetic hysteresis or other possible instabilities of the system such that the residual of the overlap is reduced to the smallest value. In this way, the new spectra best fits to the averaged spectra to effectively reduce mass drift effects on the peak averaging. The best fitted spectra may then be averaged.

Ideally, the method further comprises changing the rate of adjusting the deflection, or other means of scanning, so as to scan the ions of species A and/or B and C at a plurality of different scan rates as they are scanned across the respective lead and/or master apertures. As a result, the number of data points recorded per unit of the scan or deflection of the ions in a first segment of the lead signal and the master signal may be different to the number of data points recorded per unit of the scan or deflection in a second segment of the lead signal and the master signal. In other words, the density of data points is greater for a first portion of the lead and/or master signal than for a second portion of the lead and/or master signals. In one example, parameters at the mass analyzer may be changed at different rates for different segments of a scan, such that more data points are recorded in a first portion of the scan of the ions than during a second portion of the scan of the ions. Alternatively the rate of scanning or change of deflection applied by an ion deflection unit may be adjusted during different portions of the ramping of the deflection. This technique is referred to herein as a segmented scan technique. As an alternative, the frequency of sampling of the data points could be varied during a segment of the scan.

Advantageously, this segmented scan technique allows a greater number of data points to be recorded in regions of the signal of greater interest. For example, a greater number of data points may be recorded where the shape of the mass spectrum is changing rapidly (for example, in the sloped regions). Fewer data points can be recorded in the flat plateau regions of the mass spectrum, as these can be assumed to be flat. As a result, the measurement of the mass spectrum can be made more efficiently, as the overall measurement time can be reduced while still providing sufficient number of data points in the regions of interest for an accurate representation of the shape of the mass spectrum.

In a second aspect, there is provided apparatus for generating a mass spectrum of sample ions using a multi-collector mass spectrometer, the mass spectrometer comprising a spatially dispersive mass analyzer, the sample ions being directed to travel through the mass analyzer and towards detectors in a detector chamber, the sample ions being deflected during their travel, the mass spectrometer comprising a lead detector arranged in the detector chamber to receive sample ions of a first ion species A having a mass to charge ratio $(m/z)_A$, and the mass spectrometer comprising a master detector arranged in the detector chamber to receive sample ions of a second ion species B having a mass to charge ratio $(m/z)_B$ and a third ion species C having a mass to charge ratio $(m/z)_C$, and wherein the ions of species A have a different nominal mass to the ions of species B and C, and further wherein the ions of species B have the same nominal mass as the ions of species C, the apparatus comprising:

a control module configured to scan ion species B and C relative to the master aperture, preferably by deflection of ion species B and C, so as to scan the ions of species B and C across a master aperture defined in a master mask of the master detector, while the ions of species A pass through a lead aperture defined in a lead mask of a lead detector; and an analysis module configured to:

receive a lead signal generated at the lead detector, the lead signal representing the ion intensity received at the lead detector from the ions of species A, while the ions of species B and C are scanned across the master aperture; and receive a master signal generated at the master detector, the master signal representing the ion intensity received at the master detector while the ions of species B and C are scanned across the master aperture;

wherein the control module is configured such that, during scanning, ions of the species A are detected by the lead detector while ions of the species B but not C, then both species B and C, and then species C but not B are detected by the master detector.

The lead or master detector may be any type of detector used for mass spectrometry, or any combination of types of detector. In a preferred embodiment, the detectors are Faraday detectors.

The analysis module and the control module may form part of a computer processor. Although described as separate modules, the control and analysis module may not be separate. The analysis and control module may be controlled via computer software, which may comprise a graphical user interface to receive user inputs and to output data. A processor comprising the control module and analysis module, or the computer software for interaction with the control module and analysis module, may be integral to the mass spectrometer or may be separate.

Preferably, the analysis module is further configured to normalize the master signal from the ions B and C using the lead signal to determine a normalized mass spectrum of the ions B and the ions C. Advantageously, the apparatus can be used to obtain a particularly precise mass spectrum in which the mass interference may be especially visible. Beneficially, the resulting normalized mass spectrum may reduce the effects of intensity fluctuations or drifts of the ion beam intensity over the measurement time. As a result, analysis techniques performed on the mass spectrum may provide more accurate estimates of the isotopic ratios within the original sample. Furthermore, the more precise mass spectrum may be suitable for analysis using different, more accurate techniques.

Optionally, the control module is further configured such that, while the ions of species B and C are scanned across the master aperture, the control module is further configured to scan the ion species A across at least a portion of the lead aperture of the lead mask of the lead detector. For instance, the deflection of the ions of species A may be adjusted simultaneously with the adjustment of the deflection of the ions of species B and C.

Optionally, the control module is further configured to change the deflection of ion species A at a lead pre-aperture deflection unit located downstream of the mass analyzer and in front of the lead aperture, the control module configured to deflect the ion species A such that the ion species A fully passes through the lead aperture while the ions of species B and C are scanned across the master aperture. In other words, while the ions species B and C are scanned, a deflection may be applied to the ion species A so as to compensate for any deflection applied to all ions, in order to hold the ions of species A in alignment with the lead aperture.

Preferably, the control module is configured to scan ion species B and C across the master aperture by adjusting the deflection of ions of species B and C during their travel through the mass analyzer and towards detectors in the detector chamber. In other words, scanning the ions of species B and C (and in some examples, also scanning the ions of species A) may be achieved by changing the deflection applied to the ions as they travel through the mass analyzer and towards the detectors at the detector chamber. For example, this may involve changing the deflection applied within the mass analyzer, or could comprise application of an additional deflection prior to entrance to the detector (for instance, by using a pre-aperture deflection unit before the aperture at the entrance to a detector).

Optionally, scanning the ions may comprise movement of the beam of ions relative to an entrance aperture at the entrance to a detector. For example, scanning the ion of species B and C may comprise movement of the ion beam relative to the master aperture. Movement of the ion beam may be accomplished either by changing the deflection of the ion beam so as to scan across the aperture, or by movement of the aperture relative to the stationary ion beam. In both cases, the effect of the relative movement is to cause the ions to be passed across the aperture so that the ion beam is first blocked by the aperture, then passes through the aperture, and is then blocked by the aperture.

Where scanning by adjusting the deflection by the mass analyzer is employed, the control module may be configured to scan ions of species B and C by adjusting the deflection by ramping the magnetic field at the mass analyzer. Alternatively, where the mass analyzer comprises an electrostatic analyzer, the control module is configured to scan the ions by adjusting the deflection by varying or ramping the electric field at an electrostatic sector of the mass analyzer. Advantageously, varying the magnetic or electric field causes the ion beams to move or scan across the face of the detector (across the mask containing the entrance slit). Therefore, adjustment of the parameters of the mass analyzer offer a more straightforward means of scanning the ion beams with respect to the aperture at the detector than by adjusting the position of the detector itself. The adjustment of the parameters of the mass analyzer may be controlled by the control module according to inputs of a user via computer software.

Optionally, the control module is configured to scan the ions or adjust the deflection by scanning an energy of the sample ions. For example, the control module may be configured to change the acceleration of the sample ions within the mass spectrometer. As the deflection of the ions within the mass analyzer is dependent on the energy of the ions, adjusting or scanning the energy of the ions causes an adjustment of the deflection of the sample ions (for example, ions of species A, B and C) passing through the mass analyzer.

The control module may be configured to scan ions B and C by changing the deflection provided by a master pre-aperture ion deflection unit downstream of the mass analyzer and in front of the master aperture. In other words, a deflection unit may be placed in the pathway of a particular ion species or number of ion species, downstream of the mass analyzer and prior to the entrance aperture of a detector. The deflection unit may then be used to adjust the deflection of only some of the ions species. In a particular example, the deflection unit is placed downstream of the mass analyzer in the pathway of ion species B and C. The deflection unit is then used to adjust the deflection of ions B and C, in order to scan ions B and C across the master aperture. Beneficially, this method of adjusting the deflection of ion species B and C avoids the necessity to also adjust the deflection of ions of species A. Therefore, ions of species A can be very precisely aligned with the lead aperture.

Preferably, for all times when at least one of the ion species B and C is being collected by the master detector, ions of the species A are passing through the lead aperture and are collected by the lead detector. Advantageously, the distance between the first position of the ions of species A at the lead aperture at the beginning of the scan and the second position of the ions of species A at the lead aperture at the end of the scan is less than the width of the lead aperture. Furthermore, preferably the respective first positions of the ions of species B and the ions of species C at the master mask at the beginning of the scan and the respective second positions of the ions of species B and the ions of species C at the master mask at the end of the scan are separated by a distance greater than the width of the master aperture. Beneficially, with correct alignment this may allow a mass spectrum for the ions of species B and C to be obtained in the master detector, as the ions beams will be scanned or deflected across the aperture upon moving between the first and second position. Simultaneously, the full ion beam of ions of species A may be received at the lead detector throughout the scan or deflection, wherein the recorded lead signal will be measured at maximum intensity throughout.

Optionally, the ions of species A comprise a first species of atomic isotope, the ions of species B comprise a second species of atomic isotope and the ions of species C comprise a species of molecular isotope. Alternatively, the ions of species A comprise a first species of molecular isotope, the ions of species B comprise a second species of molecular isotope and the ions of species C comprise a third species of molecular isotope. For instance, ions of species A and B may be different isotopes of the same element, and the ions of species C may comprise an isotope of a molecule.

Advantageously, the lead detector is movable, and the control module is further configured to position the lead detector within the detector chamber to receive the ions of species A. For instance, the position of the detector may be adjusted relative to the ion beam of the ions species of interest, in order to provide the correct alignment for successful application of the method (i.e. so that the ions of species A are incident towards the lead detector). The lead detector may be motorized, such that the control module controls a motor to move the lead detector within the detector chamber without requiring direct access to the inside of the detector chamber.

The master detector may be movable, and the control module may be further configured to position the master detector within the detector chamber to receive the ions of species B and the ions of species C. The position of the detector may be adjusted relative to the ion beam of the ions species of interest, in order to provide the correct alignment for successful application of the method (i.e. so that the ions of species B and C are incident towards the master detector). The master detector may be motorized, such that the control module controls a motor to move the master detector within the detector chamber without requiring direct access to the inside of the detector chamber. Alternatively, the master detector may be fixed, with the lead detector being moveable with respect to the master detector.

Optionally, the mass spectrometer comprises a plurality of detectors in the detector chamber, each detector comprising a mask having an aperture, and the control module is further configured to select the lead detector and/or the master detector from the plurality of detectors to select a size of the lead and/or master aperture respectively. Beneficially, this allows a greater flexibility in the configuration and arrangement of the mass spectrometer which can be used to apply the method. The size of the aperture may be the dimension of the aperture in the direction of the scan, for example the width of the aperture or entrance slit.

Optionally, the analysis module is configured to determine a normalized mass spectrum of the ions B and the ions C by dividing the master signal at a given point in time by the lead signal acquired at the same point in time. This may be especially useful to eliminate fluctuations in the electron beam where only one trace of the master signal is acquired.

Advantageously, the analysis module is further configured to store the normalized mass spectrum of the ions of species B and the ions of species C as a first normalized mass spectrum, to obtain a second normalized mass spectrum in the same way as the measurement of the first normalized mass spectrum, and to determine an average normalized mass spectrum from an average of the first and the second normalized mass spectrum. Beneficially, this provides a normalized mass spectrum with increased precision, and is especially useful to reduce the effects of anomalous data points in the measured mass spectrum.

Preferably, the analysis module is further configured to store the averaged normalized mass spectrum as a first or former average normalized mass spectrum, to obtain a further or new normalized mass spectrum, and determine an average normalized mass spectrum from an average of the first or former average normalized mass spectrum and the further or new normalized mass spectrum. This technique may be repeated many times in order to overlay each successive new normalized mass spectrum with the former average mass spectrum in order to provide a new average normalized mass spectrum. Use of this technique allows small drifts of the peak positions and small instability peaks (for example, as a result of high voltage spikes) to be effectively eliminated.

The new normalized mass spectrum may be fitted to the average normalized mass spectra using known statistical techniques (for example, fitting the new spectra to reduce the residual of the overlap to the smallest value). Beneficially, the new normalized mass spectra best fits to the averaged normalized mass spectra to effectively reduce mass drift effects on the peak averaging. The averaged normalized mass spectrum may then be recalculated to take into account the best-fitted new normalized mass spectra. In this way, newly measured normalized mass spectra are "overlaid" on to the previous average normalized mass spectrum.

Advantageously, the control module is configured to change the rate of adjustment of scan or deflection so as to scan the ions of species A, B and/or C at a plurality of different scan rates as they are scanned across the respective lead and master apertures. In other words, where the sampling frequency of the measurement points remains unadjusted, the change in the rate of the scan (or change in the rate of variation of the scan or deflection of the ions) causes a different number of data points to be collected in a first segment of the lead or master signal than in a second segment of the lead and/or master signal. Alternatively, the sampling rate for measurement of the data points can be adjusted for different segments of the measurement.

Advantageously, this technique allows a greater number or density of data points to be recorded in regions of the lead and/or master signal in which the shape of the mass spectrum is changing rapidly (for example, in the sloped regions). Fewer data points may be recorded in the flat plateau regions of the mass spectrum, as these can be assumed to be flat. As a result, the measurement of the mass spectrum is more efficient and the overall measurement times can be reduced.

In a third aspect, there is provided a multi-collector mass spectrometer, comprising:

a spatially dispersive mass analyzer;

a detector chamber the sample ions being directed to travel through the mass analyzer and towards detectors in a detector chamber, the sample ions being deflected during their travel, the detector chamber comprising a lead detector arranged such that sample ions of a first ion species A having a mass to charge ratio $(m/z)_A$ are aligned with a lead aperture defined in a lead mask at the lead detector, the detector chamber further comprising a master detector arranged such that sample ions of a second species B having a mass to charge ratio $(m/z)_B$ and ions of a third species C having a mass to charge ratio $(m/z)_C$ are aligned with a master aperture defined in a master mask at the master detector; and an apparatus comprising:

a control module configured to adjust the position of ion species B and C relative to the master aperture so as to scan the ions of species B and C across the master aperture defined in the master mask of the master detector, while the ions of species A pass through the lead aperture defined in the lead mask of the lead detector; and an analysis module configured to:

receive a lead signal generated at the lead detector, the lead signal representing the ion intensity received at the lead detector from the ions of species A, while the ions of species B and C are scanned across the master aperture;

receive a master signal generated at the master detector, the master signal representing the ion intensity received at the master detector while the ions of species B and C are scanned across the master aperture; and normalize the master signal from the ions B and C using the lead signal to determine a normalized mass spectrum of the ions B and the ions C.

The mass spectrometer may further comprise the apparatus including the additional features described earlier in this document, wherein the lead aperture, the master aperture and the controller are configured such that, during scanning, ions of the species A are detected by the lead detector while ions of the species B but not C, then both species B and C, and then species C but not B are detected by the master detector. For instance, the controller may be configured to apply a deflection such that during scanning, ions of the species A are detected by the lead detector while ions of the species B but not C, then both species B and C, and then species C but not B are detected by the master detector, wherein the extent of deflection is relative to the lead and master aperture.

Ideally, the mass spectrometer is a double-focusing mass spectrometer, having an electrostatic analyzer and a magnetic sector. Optionally, the mass analyzer is a magnetic mass analyzer, which causes a deflection and separation of the ion species by application of a magnetic field. The spatially dispersive mass analyzer causes the ions of different species (and different mass-to-charge ratio) to be deflected at a different angle or to a different extent when passing through the mass analyzer, such that the ions are separated at a distance from each other.

Preferably, the mass spectrometer may further comprise an ion deflection unit downstream from the mass analyzer. The ion defection unit may be arranged prior to the master aperture, such that the ions of species B and C are passed through the deflection unit. In use, the deflection unit may adjust the deflection of ions of species B and C.

In a fourth aspect, there is provided a computer program, configured such that when executed by a processor, the computer program controls an elemental mass spectrometer to operate in accordance with the method described above. For example, the computer program may comprise logic, that when executed on a computer allows control of the mass spectrometer and the apparatus described above for execution of the method.

In a fifth aspect, there is provided a method for determining the abundance of ion species in a sample using a multi-collector mass spectrometer, the mass spectrometer comprising a spatially dispersive mass analyzer to direct the sample ions into a detector chamber, wherein the sample comprises sample ions of a first ion species A having a mass to charge ratio $(m/z)_A$ ions of a second ion species B having a mass to charge ratio $(m/z)_B$ and ions of a third ion species C having a mass to charge ratio $(m/z)_C$, wherein the ions of species A have a different nominal mass to the ions of species B and the ions of species C and ions of species A do not mass interfere or do not significantly mass interfere with any other ion species, and further wherein the ions of species B have the same nominal mass as the ions of species C, the method comprising:

(a) performing the method according to any one of claims 1 to 12, to provide a normalized mass spectrum of the ions of species B and the ions of species C;

(b) deconvolving a mass peak of each of the ions of species B and of species C from the normalized mass spectrum, according to the assumption that the shape of the mass peak of the ions of species B is the same as the shape of the mass peak of the ions of species C; and (c) determining an abundance of the ions of species A, the ions of species B and/or the ions of species C within the sample.

The determined abundances may be used for determining one or more abundance ratios, e.g. isotope ratios. The ratio may be determined according to relative abundances (amplitudes of the mass peaks) of each of the ions of species A, the ions of species B and the ions of species C.

The ions of species A preferably do not mass interfere or do not significantly mass interfere with any other ion species so that an accurate peak shape may be measured for species A. In other words the mass of species A is sufficiently different from the mass of ions B and C that the mass peak of species A is spaced apart from the mass peaks of species B and species C.

The method of obtaining a normalized mass spectrum for ions of species B and C is described above in detail. Advantageously, a plurality of normalized mass spectra for ions of species B and C are measured such that an average or best-fit normalized mass spectrum is obtained. For example, the average normalized mass spectrum may be obtained by "overlaying" newly measured mass spectra to an average normalized mass spectrum previously obtained (according to the method described above).

The deconvolution of a mass peak for each of the ions of species B and C may be accomplished by application of standard signal processing techniques to the normalized mass spectrum. The deconvolution assumes that the shape of each of the mass peaks of the ions of species B and the ions of species C will be identical. This assumption may be considered accurate due to the common ion source and common acceleration stages for each ion species, which provide a similar angular momentum and energy distribution for ions of every species. Although this assumption is most accurate in relation to mass spectra measured in a double focusing mass spectrometer, the assumption may also be reasonably applied to mass spectra obtained in single focusing magnetic sector mass spectrometer. Any suitable algorithm may be applied (for example at an analysis module of a computer processor) to deconvolve or resolve the mass peaks from the mass interfered mass spectrum.

The use of the master and lead detectors to normalize the mass peaks, optionally together with the spectrum averaging and segmented scan techniques, improves the quality of the measurement of the mass spectrum and thus allows for effective deconvolution of the interfering mass peaks and thereby an improved determination of the ion abundances.

Once the mass peaks of ions of species B and species C have been obtained according to the method above, techniques standard to mass spectrometry analysis may be applied to obtain the isotopic ratio of each ion species.

Preferably, the method further comprises measuring at a detector arranged in the detector chamber a full mass spectrum of the ions of species A, or ions of another species that does not mass interfere or significantly mass interfere with any other ion species, to determine a mass peak having a mass peak shape of the ions of species A or for the ions of the other non-mass interfering species. The step of deconvolving the mass peak of each of the ions of species B and of species C from the normalized mass spectrum assumes that the shape of the mass peak of the ions of species B is the same as the shape of the mass peak of the ions of species C and the same as the shape of the mass peak measured for the ions of species A or of the other non-mass interfering species The mass peak of ions of species A or ions of another species that does not mass interfere or significantly mass interfere with any other ion species can be obtained by measuring a mass spectrum at a detector, e.g. at the lead detector or master detector but preferably at the master detector. The ion should be selected so that the mass spectrum is not mass interfered. The mass spectrum for ions of species A or the ions of another species that does not mass interfere or significantly mass interfere with any other ion species is fully scanned or deflected across the entrance silt to the detector (for instance, from a first position at which the ion beam is blocked by the mask on one side of the aperture, to a position at which the ion beam is blocked by mask at the opposite side of the mask). The shape of the mass peak can then be established from the shape of the measured mass spectrum. In particular, the shape of the sloped regions of the mass spectrum as the ions begin to enter and exit the aperture of the detector reflects the shape of the mass peak. It may be beneficial to measure the mass spectrum of the ions of species A, or other non-interfered ion species, using a technique (as described above) which provides a greater density of measurement points in the sloped segments of the mass spectrum.

Preferably, measuring a full mass spectrum of the ions of species A or ions of another species that does not mass interfere or significantly mass interfere with any other ion species comprises:

measuring at a master detector a high resolution full mass spectrum of a first ion species while measuring at a lead detector a high resolution full mass spectrum of a second ion species, wherein the first and second ion species are different ion species and are either ions of species A or ions of another species that does not mass interfere or significantly mass interfere with any other ion species; and normalizing the signal measured at the master detector to the signal measured at the lead detector to determine a normalized full mass spectrum for the ions of species A or of the other non-mass interfering species. Beneficially, this provides a very high precision peak shape for the non-mass interfering ion, which can then be used in the convolution of the peak shape of ions of species B and species C. A more accurate peak shape for the non-mass interfering ion results in better quantification of the contributing species in the measured, normalized mass-interfering mass spectrum. This is due to a more accurate deconvolution of the mass peaks. Use of the lead and master detector to capture the normalized peak shape of a non-mass interfering ion in this way allows a normalized peak shape to be established which is independent from small fluctuations at the source of the sample ions or elsewhere in the mass spectrometer. As such, this technique is useful to correct for drift of the ion beams.

Preferably, deconvolving a mass peak for each of the ions of species B and of species C (at step (b) above) further comprises:

fitting to the normalized mass spectrum a mass peak of ion species B and a mass peak of ion species C, wherein the shape of the mass peak of ion species B and the shape of the mass peak of ion species C are the same as the shape of the mass peak of the ions of species A or of the other non-mass interfering species measured with the master detector;

wherein the mass peak for ion species B and for ion species C is fitted by adjusting the amplitude of each mass peak and/or the mass at which each mass peak occurs. In other words, it is assumed that the mass peaks of ion species B and C will be identical in shape to the mass peak measured for the non-mass interfering ion. Preferably, the peak shape for the non-mass interfering ion is measured with very high precision using a normalized signal measured at the lead and master detector. By using the high precision peak shape measurements, the mass peaks for ion species B and C can be deconvolved using a fitting technique to fit identical peak shapes to the normalized mass spectrum. As the peak shape is known, the mass peaks for ion species B and C can be found by adjustment of at least one fitting parameter to the measured normalized mass spectrum of mass-interfering ion species B and C. Primarily, the fitting parameter will be a scaling factor for the amplitude of each mass peak, although where the exact mass of the ion species B and C are not known, the mass may also be used as a fitting parameter.

As a result of the powerful deconvolution technique described, calculation of the abundance of sample ions B and C does not rely on identification of plateaus in the full mass spectrum, unlike in previously known methods. Accordingly, the measurements used here to determine the abundance of ion species in a sample may require less high resolution measurements (e.g. by using a higher transmission of electrons to the ion detector), without compromising on precision. As a result, abundance of species separated only by very small mass defects can be better distinguished. Furthermore, the method is especially effective where a large number of different species of ions mass-interfere.

Although the mass may be used as a fitting parameter during deconvolution of the mass peaks for ion species B and C, in general the exact mass (the exact atomic or molecular mass) of each ion species present within a sample will be known. For example, the mass of ions of an atomic or molecular species will be known from previously documented measurements. The exact mass will be the mass that is commonly accepted as the true atomic or molecular mass for a given atom or molecule, respectively.

Optionally, the determined abundances may be used for determining one or more abundance ratios, the ratios determined according to relative amplitudes of the deconvolved mass peaks of at least two of the ions of species A, the ions of species B and the ions of species C.

Preferably, the sample ions may further comprise ions of one or more further ion species, wherein the ions of each of the one or more further ion species have the same nominal mass as the ions of species B and species C, and the method further comprises deconvolving a mass peak of each of the ions of species B, species C and each of the one or more further ion species from the normalized mass spectrum, according to the assumption that the shape of the mass peak of the ions of species B, species C and each of the one or more further ion species is the same as the shape of the mass peak measured for the ions of species A or for the ions of the other non-mass interfering ion species. The one or more further ion species may each have a mass-to-charge ratio (m/z), wherein the mass-to-charge ratio is different for each of the further ion species.

BRIEF DESCRIPTION OF THE DRAWINGS

A method and apparatus for obtaining a mass spectrum of sample ions in accordance with an aspect of the present disclosure is described, by way of example only, with reference to the following drawings, in which.

Where appropriate, like reference numerals denote like elements in the figures. The figures are not to scale.

DETAILED DESCRIPTION OF SPECIFIC EMBODIMENTS OF THE INVENTION

Figure 1:
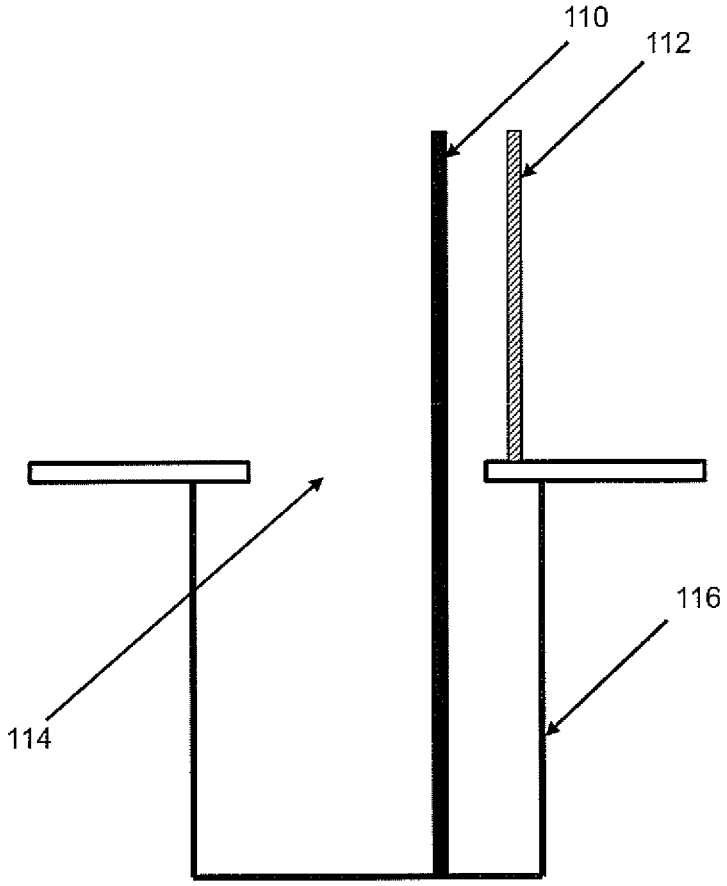
FIG. 1 Prior art
FIG. 1 is a schematic view of the alignment of Faraday detectors according the a method described in the prior art.
Figure 2A:
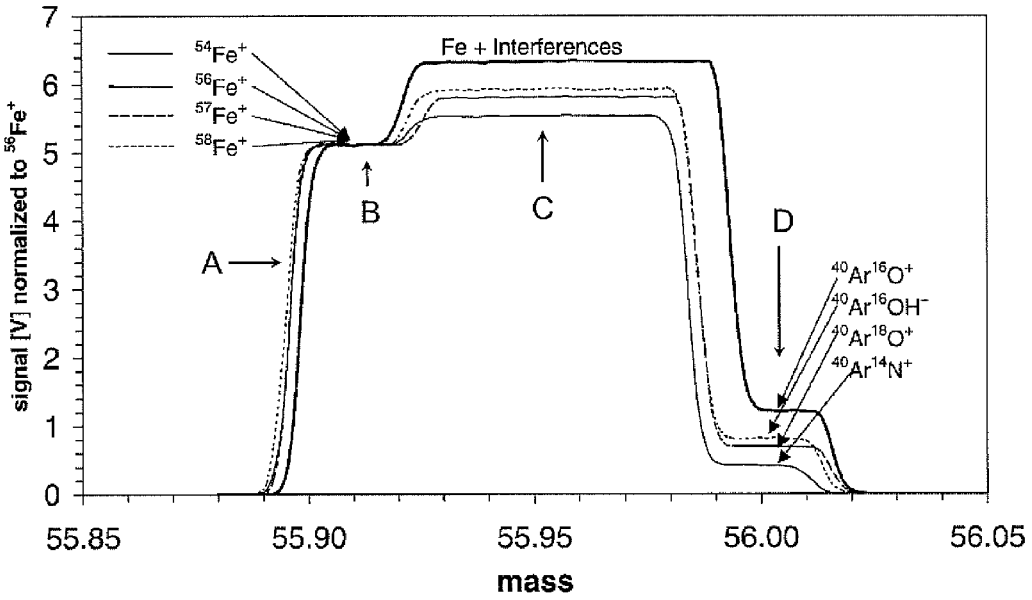
FIG. 2A Prior art
FIG. 2A is a plot of the mass spectrum showing all Fe isotopes and their respective molecular interferences, obtained by methods described in the prior art.
Figure 2B:
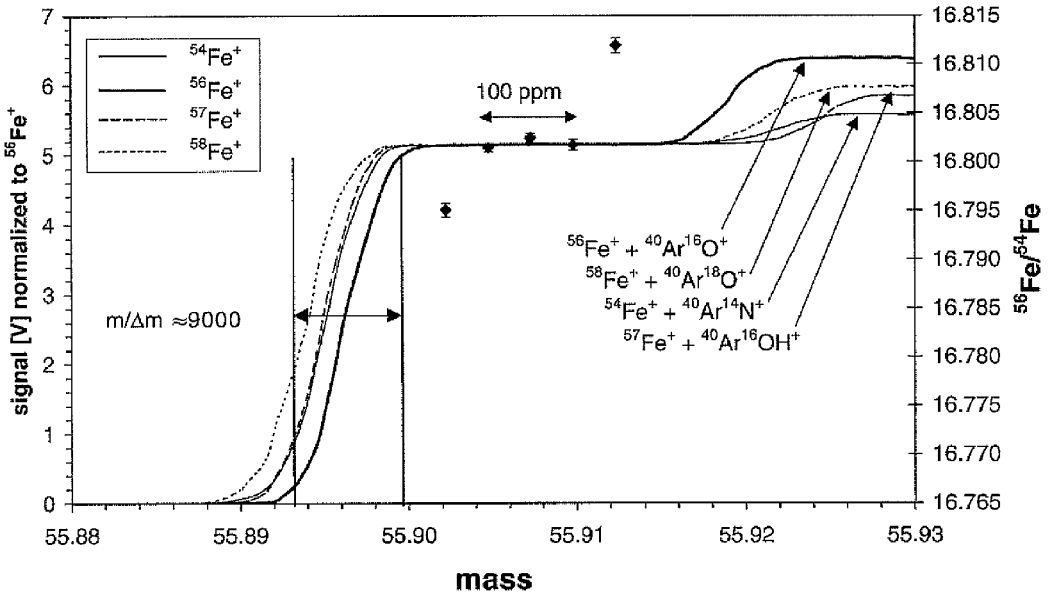
FIG. 2B Prior art
FIG. 2B is a magnified view of a portion of the mass spectrum of FIG. 2A, which was obtained by methods described in the prior art.
Figure 3:
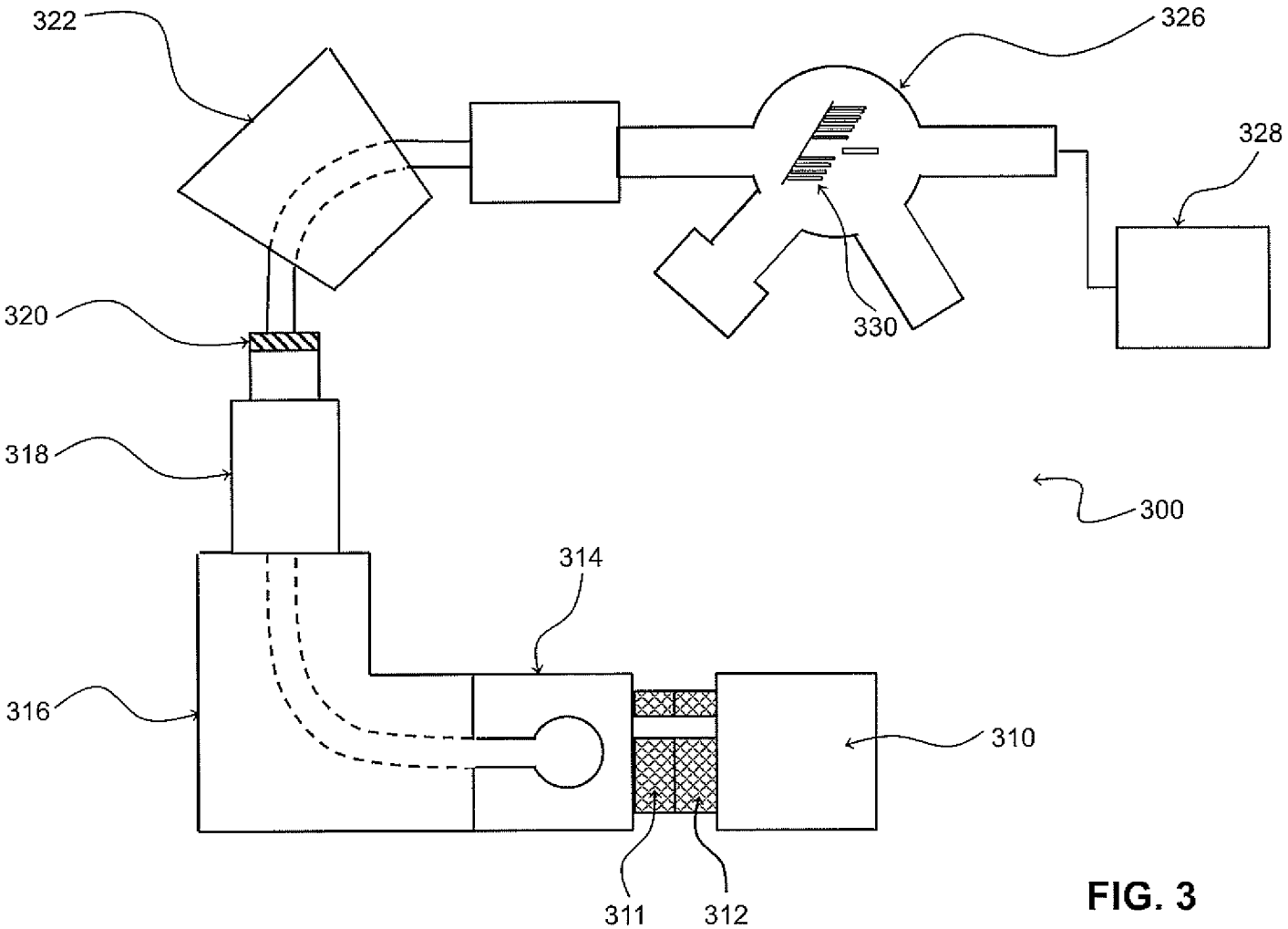
FIG. 3 is a schematic view of a multi-collector double focusing mass spectrometer.

Referring first to FIG. 3, there is shown a schematic representation of a double focusing mass spectrometer 300. The ions are generated at the ion source 314 which is powered by power supply 310 connected via connectors 311, 312. The ions are accelerated and focused on an entrance slit and then passed through an electrostatic analyzer (ESA) 316 which assists in focusing the ion beam and selecting ions of the required energy. The ions next enter a focusing quadrupole 318 to further focus the ion beam. On exiting the focusing quadrupole, the ion beam passes through an exit aperture defined in a mask 320, and then onwards through a magnetic field applied at the electromagnetic sector 322.

The exit aperture at mask 320 has different possible widths which determine the resolution of the ion beam. As the aperture allows only a portion of the focused ion beam to pass, selection of an aperture having a larger area or wider slit allows a greater portion of the ion beam (in other words, a larger number of ions) to pass through into the magnetic field, and so provides a more sensitive measurement. However, a small area or narrower aperture can be useful to reduce ion optical aberrations, thereby delivering improved resolution for the measurement. Use of a higher resolution aperture may be preferred for implementation of the method described herein, as this results in ions having a mass peak that is narrower with relatively less overlap. Therefore, the high resolution is helpful to resolve ion species having mass interfered mass peaks.

Within the magnetic mass analyzer at the electromagnetic sector 322, the applied magnetic field causes a change of direction or a deflection of the ions. Ions of greater mass are deflected less than ions with smaller mass, causing a spatial separation of the ions according to their mass-to-charge ratios. The separated ions exit the magnetic mass analyzer 322 and pass into the detector chamber 326. A plurality of detectors 330 including Faraday detectors and conventional differential detectors (CCD) are arranged within the detector chamber (see also FIG. 4B). The detectors 330 are arranged in a plane in order to receive each species of spatially separated ions simultaneously. The operation of the mass spectrometer and the collection of data may be controlled by a computer 328 having a control module and analysis module.

A Faraday detector (also known as a Faraday cup or Faraday collector) is a conductive cup arranged to collect ions within its chamber or cavity. As the charged particles are received within the Faraday detector, the build-up of charges at the walls of the conductive cup give rise to a current which is proportional in magnitude to the number or intensity of ions collected.

Figure 4A:
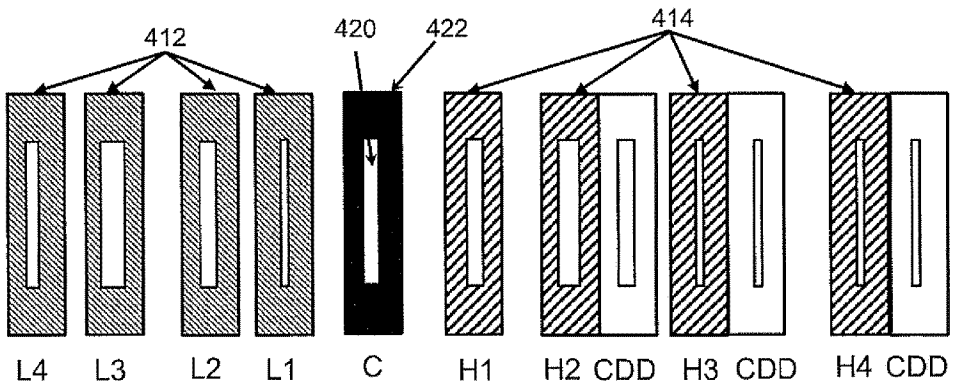
FIG. 4A is a schematic view of the arrangement of the plurality of Faraday detectors and CDD detectors at a plane within the detector chamber of a mass spectrometer.

FIG. 4A shows the arrangement of Faraday detectors 410, 412, 414 and CDD detectors 416 within the detector chamber 326. A number of moveable Faraday detectors 412, 414 (labelled L1 to L4 and H1 to H4) are arranged either side of a fixed center Faraday detector 410 (labelled C). Three CDD detectors 416 are also positioned at one side of the center Faraday detector 410. Each Faraday detector comprises an aperture 420 defined in a mask 422. The masks are arranged across the entrance to the Faraday detector, such that ions must pass through the aperture 420 to enter the Faraday detector. Across the plurality of Faraday detectors 410, 412, 414, the apertures have a range of slit widths. Slit L3 has the widest slit width, e.g. 1.8 millimeter in a particular example. Compared to slit L3, the other detectors may have a relative width of, for example, 0.9, 0.8, 0.7, 0.6, 0.5, 0.4, 0.3, 0.2 and/or 0.1 the width of L3. This would result in a slit of 0.7 the width of L3 being around 1.3 millimeter wide, for instance, and a slit of 0.3 the width of L3 being around 0.5 millimeter wide.

Figure 4B:
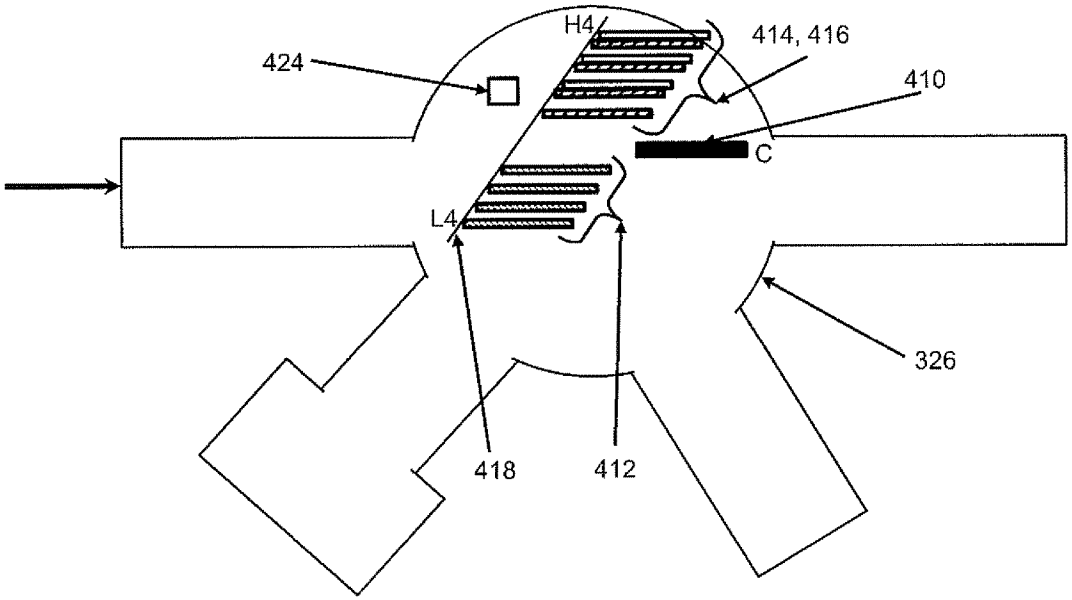
FIG. 4B is a plan view of the arrangement in the detector chamber of the mass spectrometer of the Faraday detectors and CDD detectors represented in FIG. 4A.

FIG. 4B illustrates the Faraday detectors arranged in a plane 418 within the detector chamber 326 when viewed from above the detector chamber. The position of the moveable Faraday detectors 412, 414 may be adjusted within the plane in order to be aligned with each of the incident separated species of ion (or incident ion beams). Adjustment of the position of the moveable Faraday detectors allows selection of a specific Faraday detector having a specific width of aperture for a given species of ions. In some cases, the center Faraday detector (C) 410 is fixed. Therefore, the direction (or deflection) of the ion beams can be tuned such that ions of a species of interest is aligned with the center Faraday detector (C) 410, and the moveable Faraday detectors 412, 414 may be positioned around the center Faraday detector 410 to align with ions of other species within the sample.

An ion deflection unit 424 is positioned downstream of the mass analyzer and prior to the aperture at the entrance to a detector (in this case, detector H2). The ion deflection unit 424 can be used to apply a deflection to a particular ion species aligned with a specific aperture and detector, without applying the same deflection to all sample ions.

A sample to be analyzed may contain a number of different species of ion. As stated above, ion species of different mass will be separated in the mass analyzer according to their mass-to-charge ratio (m/z). Where the nominal mass of different ions species is not the same, the ion beams are separated so as to be relatively well resolved. However, where ions having nominally the same mass are present in the sample, the ion beams may not be well resolved (such that their mass peaks overlap). In the case that the ion beams are not well resolved, a mass interference is observed.

As discussed previously, different ions of nominally the same mass have a slightly different true mass as a result of the mass defect. In this case, mass interfered species of ions can only be resolved by obtaining a very high precision mass spectrum. This high precision mass spectrum can be obtained according to the method and apparatus described below with reference to FIGS. 5 to 9. Furthermore, a method and apparatus for estimating isotopic ratios in the presence of mass interferences is described below with reference to FIG. 10.

Obtaining a Normalized Mass Spectrum

Figure 5A:
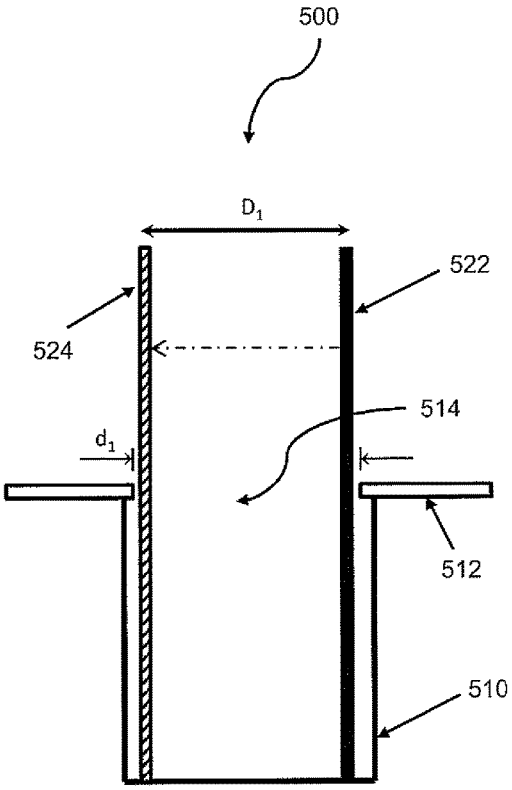
FIG. 5A is a schematic view of the configuration of the lead Faraday detector with respect to the ions of a first species (A)
Figure 5B:
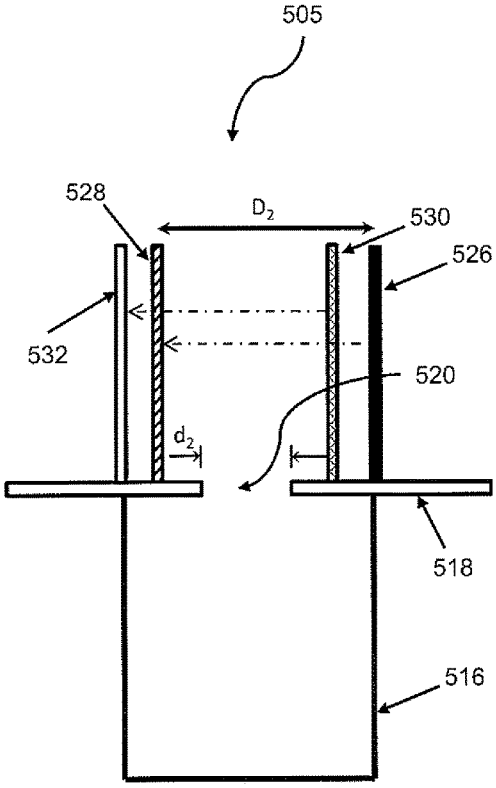
FIG. 5B is a schematic view of the configuration of the master Faraday detector with respect to the ions of a second and third species (B and C respectively)

FIG. 5A and FIG. 5B illustrate Faraday detectors. FIG. 5A shows a lead Faraday detector 500 with a lead mask 512 at the entrance to the cup portion 510 of the detector. A lead aperture 514 is formed in the mask 512 and has a first width, $d_1$. FIG. 5B shows a master Faraday detector 505 with a master mask 518 extending across the entrance to the cup portion 516 of the Faraday detector. The mask comprises a master aperture 520 having a second width, $d_2$. The first width $d_1$ of the lead aperture 514 of the lead Faraday detector 500 is greater (or wider) than the second width $d_2$ of the master aperture 520 of the master Faraday detector 505 (in other words, $d_1 > d_2$). In this example, the master Faraday detector 500 is equivalent to the fixed, central Faraday detector 410 shown in FIG. 4A and FIG. 4B, and the lead Faraday detector 505 is selected from those of the moveable Faraday detectors 412, 414 that have a wider aperture. As such, the lead Faraday detector 500 can be selected to provide a desired width of lead aperture. As an example only, the lead Faraday detector 505 may be detector L3 in FIG. 4A, which has the widest entrance slit to the detector.

As illustrated in FIG. 5A, the lead Faraday detector 500 is aligned to receive or collect a species of ion (represented in a first position by an ion beam 522 represented as a solid line). This is a first ion species (which could be denoted as ions of species A) which has a different nominal mass than any other species of ions present in the sample being analyzed. At a result, the ions of the first species are well resolved in the mass spectrum from other ions present in the sample, and the ion beam is separated from the ion beam of any other species. As a result, only a single ion species is incident to the lead Faraday detector.

As illustrated in FIG. 5B, the master Faraday detector 505 is arranged to collect a second and third species of ion (the second species being represented by an ion beam 526 (solid line) in a first position, and the third ion species being represented by a second ion 530 beam (solid line) in the first position). The second and third species may be denoted ions of species B and ions of species C respectively. The second and third ion species have the same nominal mass, and are separated in the mass spectrum by only the mass defect. As such, the second and third ion species represent a mass interfered ion beam. In a particular example, the second ion species is an atomic ion species, and the third ion species is a polyatomic or molecular ion species. In an alternative example, the second and third ions are each molecular species. In further examples, fourth or further ion species may also mass interfere with the second and third ion species.

At a first time, the lead Faraday detector 500 is arranged such that the ions of a first species enter the detector portion 510 of the Faraday detector 500 through the aperture 514 of the mask 512. As illustrated in FIG. 5A, ideally at a first time the ion beam 522 of the first ion species is aligned in a first position inside a first edge of the lead aperture 514.

At the same first time, the master Faraday detector 505 is arranged such that the ions of the second and the third species are blocked from entering the cup portion 516 of the Faraday detector 505 by the master mask 518. The ions of the second and third species are incident toward the master Faraday detector 505, but intersect with the Faraday detector 505 at the mask 518 outside and adjacent to a first edge of the master aperture 520. The arrangement is such that, at the first time and the first position, the ion beams of the second and third ion species do not enter the cup portion 516 of the master Faraday detector 505.

The ion beams of the first, second and third species are simultaneously scanned or deflected across the surface of the masks 512, 518 of the master Faraday detector 510 and lead Faraday detector 505 respectively. In this example, the movement of the ion beams is a result of a change in the magnetic field applied in the magnetic mass analyzer 322. Gradual ramping or scanning of the magnetic field results in a gradual variation in the direction or deflection of the ion beams within the mass analyzer 322. As a result the position of each ion beam at the mask 512, 518 of each Faraday detector 510, 505 moves relative to the aperture 514, 520 at each Faraday detector 500, 505. An example of the direction of displacement of the ion beams during the scan is represented by the dotted arrows at FIGS. 5A and 5B.

As a result of the scan or change in the deflection, the ion beams of the first, second and third species are displaced. At the maximum extent of the change in the deflection of the ion beams, the displacement of the ion beams at the respective the masks 512, 518 of the lead Faraday detector 500 and master Faraday detector 505 reaches a maximum. At the lead Faraday detector 500, the ion beam of the first ion species is displaced by a distance $D_1$ until reaching a second position. The second position of the ion beam of the first species is aligned adjacent the second, opposite inside edge of the lead aperture (the ion beam in the second position 524 is shown as a cross-hatched line in FIG. 5A). In other words, the ions of the first species are still able to enter the cup portion 510 of the lead Faraday detector through the lead aperture 514 when in the second position 524. Therefore, throughout the period in which the deflection or scan of the first ion species takes place, the full ion beam enters the cup portion 510 of the lead Faraday detector 500.

At the master Faraday detector 505, during the period of the scan or change in deflection, the second and third ion beams are moved across the face of the mask 518 and across the aperture 520. The ions of the second and third species are displaced by a distance $D_2$ until reaching a second position (the second species of ions in the second position is shown as cross-hatched ion beam 528 in FIG. 5B, and the third species of ions in the second position is shown a hollow ion beam 532 in FIG. 5B). At the second position, both the second 528 and third 532 ion beams are blocked by the mask 518, and located adjacent the opposite, outside edge of the master aperture 520. As such, during the period of the scan of the second and third ions beams, the ions of the second species are first able to enter the cup portion 516 of the master Faraday detector 505 through the master aperture 520 at the mask 518, with the ions of the third species still blocked by the mask. Subsequently, both the ions of the second and third species are able to enter the cup portion 516 of the master Faraday detector 505, and then only the ions of the third species are able to enter the cup portion 516 of the master Faraday detector 505. Finally, at the second position of the ion beams at maximum displacement $D_2$, both ion beams are blocked by the mask 518 once again.

Figure 6A:
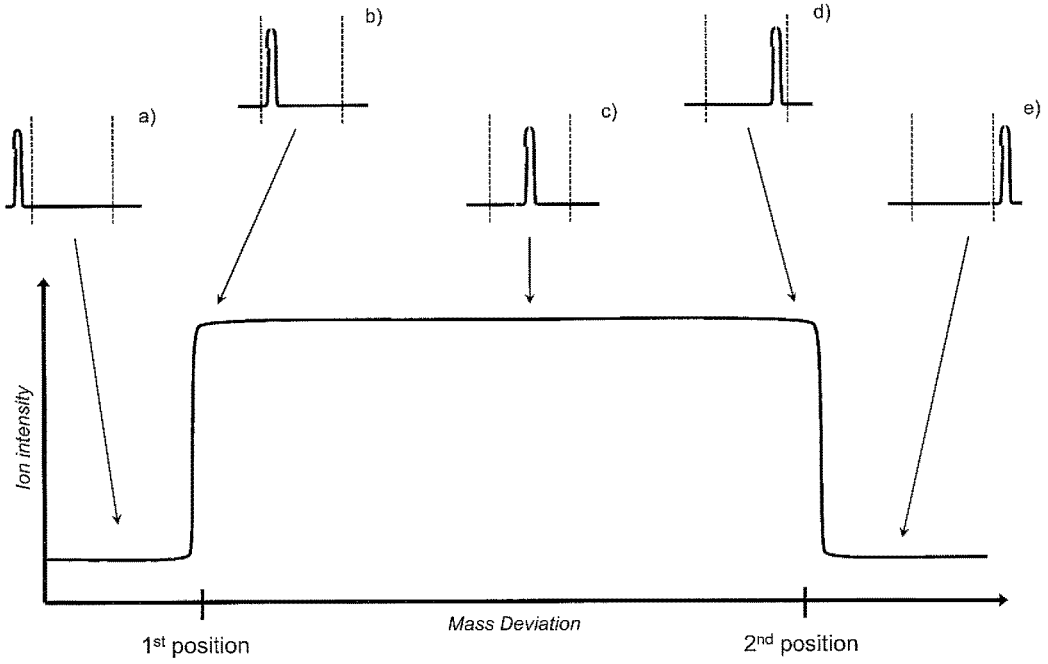
FIG. 6A is a plot of the lead signal at the Faraday detector, with insets showing the position of the ion peak of the first species (A) relative to the aperture.
Figure 6B:
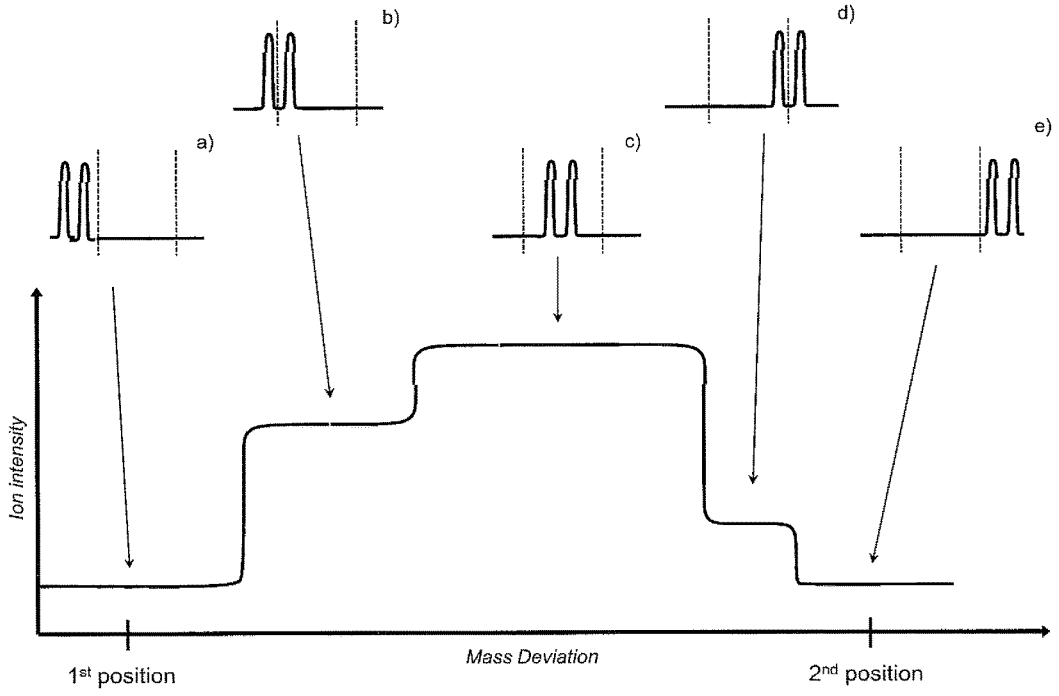
FIG. 6B is a plot of the master signal at the master Faraday detector, with insets showing the position of the ion peaks of the second and third species (B and C) relative to the aperture.

Throughout the period of the scan, the signal at the lead Faraday detector 500 and the master Faraday detector 505 is measured. FIGS. 6A and 6B show the signals received by the lead Faraday detector and the master Faraday detector respectively. FIG. 6A is a plot of the lead signal, which represents the ion current (or intensity) measured at the cup portion 510 of the lead Faraday detector 500 during the scan or change in the deflection at the mass analyzer. The x-axis shows the mass deviation, which is proportional to the change in deflection of the ion of the first species as the field in the mass analyzer is changed or ramped. FIG. 6B is a plot of the master signal, which represents the ion current (or intensity) measured at the cup portion 516 of the master Faraday detector 505 during the scan or change in deflection. In FIGS. 6A and 6B, the signal is shown for a deflection of the ion beams which extends beyond the first and second position discussed above, although the first and second positions are labelled at the x-axis. The insets to FIGS. 6A and 6B show a representation of the position of the mass peak or ion beams within the aperture of the mask at the lead and master Faraday detectors.

Referring to FIG. 6A, at the first position discussed above (represented by inset b) the mass peak of the first ion species resides at the left hand side, but within, the lead aperture. At the center of the scan, the mass peak for the first ion species resides at the center of the lead aperture (marked as c in FIG. 6A). At the second position of the ion beam (marked as d) the mass peak of the first species resides at the right hand side, but within, the aperture of the lead Faraday detector. Throughout the displacement of the ion beam from the first position to the second position, the full mass peak is within the aperture of the lead Faraday detector. As a result, the ion current between the first and second position is relatively stable. The lead signal represents a flat plateau at maximum intensity throughout the period of the scan or deflection of the first ion beam. Regions a) and e) of FIG. 6A represent the lead signal when the displacement of the ion beams is increased such that the ions of the first species can no longer enter the lead Faraday detector and are blocked by the lead mask. Here, the ion intensity reduces to zero.

Considering FIG. 6B, at region a) the ion beams of both the second and third ion species is aligned outside of the aperture of the mask at the master Faraday detector. As the scan of the ions proceeds, the mass peak for the second ion species moves into the aperture, but the mass peak for the third ion species remains blocked by the mask (marked as region b). In the center of the scan or variation of the deflection (marked as region c) the mass peak of both the second and third ion species passes through the master aperture and is received into the master Faraday detector. Upon still further displacement of the ions beams, the mass peak of the second ion species moves outside of the master aperture and is blocked by the master mask, although the ion beam for the third ion species remains within the aperture so at to be able to pass into the master Faraday detector (marked as region d). Finally, once the ions beams are at the greatest extent of the scan or deflection and have reached the maximum displacement, both the mass peaks for the second and third ion beams have moved outside of the aperture and are blocked by the master mask (marked as region e).

The plot of the ion intensity shown in FIG. 6B represents the mass spectrum of the second and third ion beams measured at the master Faraday detector. A plateau in the ion intensity in region c) represents the maximum intensity, when both ion beams are able to pass into the cup portion of the Faraday detector. Plateaus of lower ion intensity at regions b) and d) of FIG. 6B are observed where only one of the second or third ion beams pass through the aperture to be collected by the master Faraday detector.

The lead signal represents the maximum ion intensity of the ions of the first species throughout the scan of the ion beam. In an ideal system, this would be constant. In real experimental data however, small variations can be observed which result from fluctuations and instability of the sample ion beam intensity over time. As a consequence of the measurement described above, these background fluctuations may be removed from the master signal by normalization with the lead signal. The result is a more precise, normalized mass spectrum for the mass interfered second and third ions. The plateau features in the normalized mass spectrum may be more distinct, allowing observation of narrower plateau associated with a very small mass defect between ion species. Such a precise mass spectrum is highly advantageous for further analysis and for estimation of the isotopic ratios of ions present in the sample.

Figure 7:
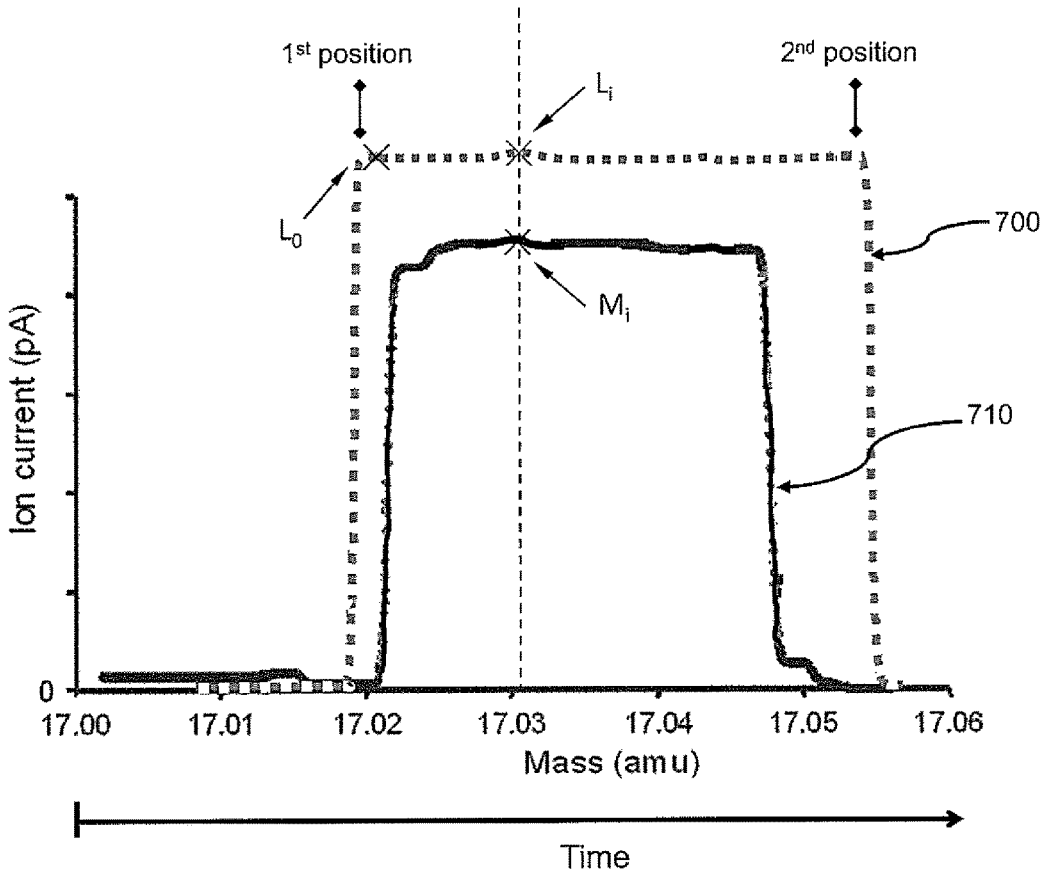
FIG. 7 is a plot showing an example of the lead signal and master signal measured according to the method.

FIG. 7 shows a specific example of a measured lead signal 700 (dotted line) and master signal 710 (solid line) before normalization. The lead signal 700 has been shifted on the mass x-axis in order for the master and lead signals to be aligned for comparison. However, as the master signal 710 and lead signal 700 were detected simultaneously, no shift has taken place in the time x-axis.

In FIG. 7, the first ion species measured at the lead Faraday detector (signal 700) was methane $^{12}CH_4^+$ having a molecular mass of 16, which constitutes the main ion beam. Three ion species were received at the master Faraday detector. The interfering ions measured at the master Faraday detector (signal 710) were $^{13}CH_4^+$, $^{12}CH_3D^+$ and $^{12}CH_5^+$ each having a nominal molecular mass of 17. It can be seen that three plateau are visible in the mass spectrum of the master signal 710, indicative of the three mass interfered ions.

It can be seen that small fluctuations are observed in the plateau of both the lead signal 700 and the master signal 710. These fluctuations, which occur simultaneously in both signals, are artefacts of experimental instability affecting all sample ions (fluctuations in the beam intensity, for example). The normalization of the master signal 710 may be used to effectively eliminate these fluctuations in the resulting mass spectrum for the ions of the second and third species.

The normalization of the master signal 710 by the lead signal 700 may be performed by dividing the master signal at a given point in time by the lead signal acquired at the same point in time. This type of point-wise normalization is especially powerful for eliminating fluctuations in the signal when only one trace is acquired. As illustrated in FIG. 7, each data point at a given time of the master signal, $M_i$, may be divided by the lead signal data point, $L_i$, that is simultaneously acquired by the lead detector at the same time point. Therefore, each data point, $P_i$, of the normalized mass spectrum of the ions of the second and third species may be calculated as $$P_i = M_i / L_i \quad \text{(Equation 1)}$$

In a further example, the normalization of the master signal may be performed relative to a standard point in the lead trace. In this case, every data point, $P_i$, of the normalized mass spectrum of the ions of the second and third species may be calculated as $$P_i = M_i (L_0 / L_i) \quad \text{(Equation 2)}$$

Obtaining an Averaged Mass Spectrum

Figure 8:
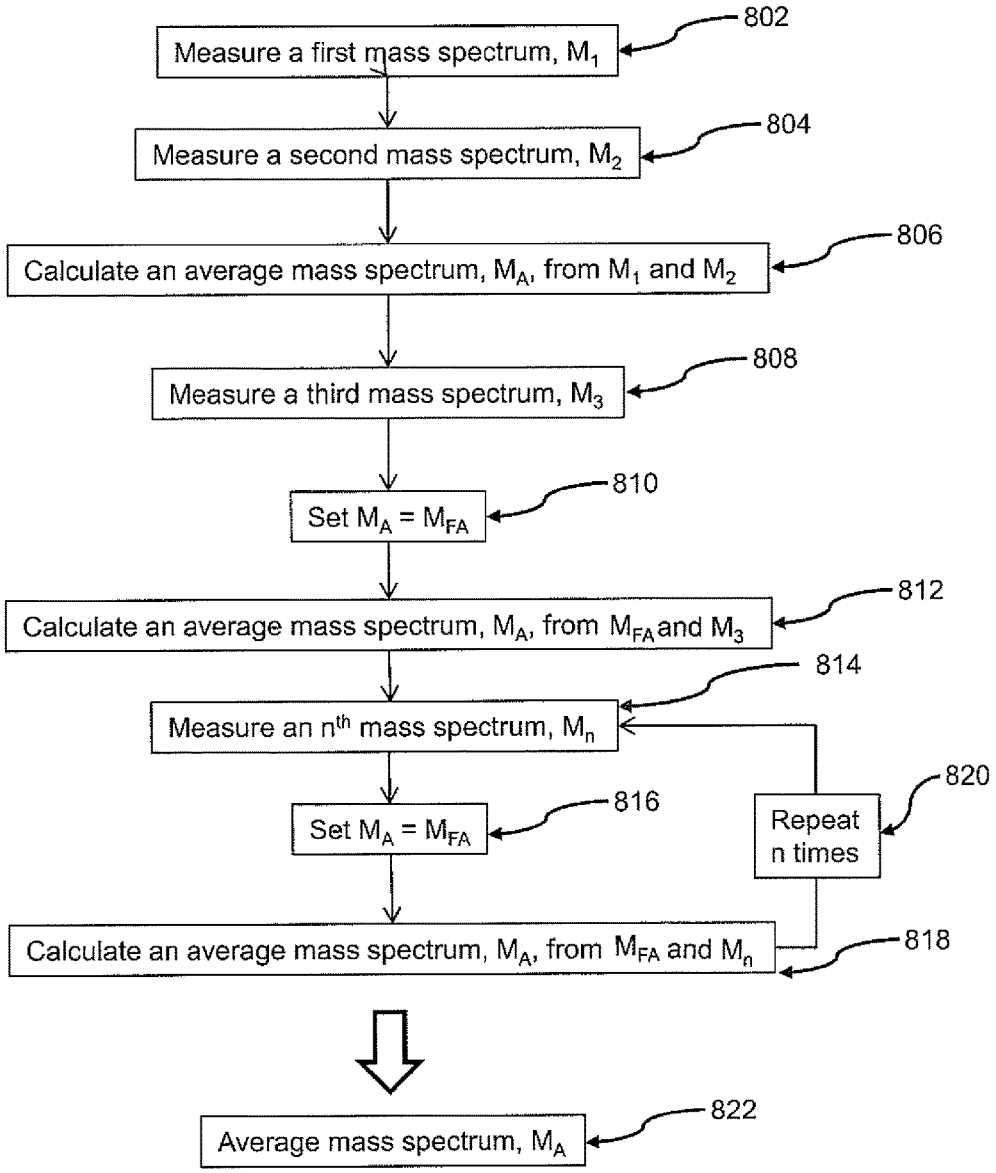
FIG. 8 is a flow diagram showing the method of a obtaining a mass spectrum of sample ions.

Further improvements can be made to the precision of the normalized mass spectrum by using additional analysis techniques. FIG. 8 describes a technique using the overlay of the measured and normalized mass spectra of the mass interfered ions to provide an average normalized mass spectrum. A first normalized mass spectrum, $M_1$, is obtained using the method described above (step 802). By repeating the method, a second normalized mass spectrum, $M_2$, is obtained (step 804). An average mass spectrum, $M_A$, is then obtained by calculating the average between the first normalized mass spectrum $M_1$ and the second normalized mass spectrum $M_2$ (step 806). For example, the mean average of the ion intensity of the first and second normalized mass spectrum may be calculated at each value of the mass deviation (e.g. due to ion beam displacement).

A third normalized mass spectrum, $M_3$, may be obtained by repeating the method described above (step 808). Where the previously calculated average mass spectrum is a former average mass spectrum, i.e. $M_A=M_{FA}$ (step 810), a new average mass spectrum $M_A$ may be determined by calculating the average of the former mass spectrum $M_{FA}$ and the third normalized mass spectrum $M_3$ (step 812).

The method can be repeated a number of times. For example, an $N^{th}$ mass spectrum $M_N$ is obtained according to the method described above (step 814). The $N^{th}$ average mass spectrum is then obtained by calculating the average of the $N^{th}$ mass spectrum and the average mass spectrum obtained after the $N-1^{th}$ repetition of the method (step 818). In other words, the average mass spectrum $M_A$ is the average of each new mass spectrum $M_N$ and the previous average mass spectrum $M_{FA}$.

A particular advantage of this method is that small drifts in the peak position or small fluctuations in the mass spectrum (for example, due to instability in the ion beam from a small high voltage spike) may be effectively excluded. This is because this method of averaging is less effected by an anomalous result than, for example, simply taking the average of all measured mass spectra at a given mass deviation. Furthermore, this method allows data points to be entirely excluded from the data set if they differ from the calculated average mass spectrum by more than specified limits. As such anomalous data points can be excluded more easily.

As an alternative, the average mass could simply be calculated by taking an average ion intensity for each mass deviation over N mass spectra. In other embodiments, the best fit mass scan for N mass spectra could be obtained using least squares regression.

Using a Segmented Mass Scan Technique

A further improvement to the precision of the measured mass spectrum may be obtained by using a segmented scan technique. Ideally, a large number of data points are recorded at the Faraday detectors during the scan or deflection of the ion beams to produce a mass spectrum. This helps the shape of the normalized mass spectrum to be correctly obtained. However, measurement of a large number of data points can require a very slow change in the rate of the scan or the rate of adjustment of the deflection (for example, the rate of change of parameters of the mass analyzer) and so very long measurement times may be needed. Not only are long measurement times inconvenient to the researcher, errors can also be introduced to the measured mass spectrum due to the drift of the ion beam intensity or the position of the mass peaks over time.

A segmented scan technique allows for collection of an increased density of data points in regions of the mass spectrum that are of particular interest and which exhibit the greatest change. For example, at the sloped regions of the mass spectrum, the peak shape changes rapidly. Therefore, to obtain an accurate representation of the peak shape it is useful to obtain a greater number of data points (per unit of mass deviation) in the region of the scan in which the peak shape is sloped. In the regions of the scan exhibiting a plateau, a reduced number of data points can be recorded, as this portion of the mass spectrum can be assumed to be approximately flat. Beneficially, this technique allows a highly accurate mass spectrum to be measured in an efficient manner and the overall measurement time can be reduced.

Figure 9:
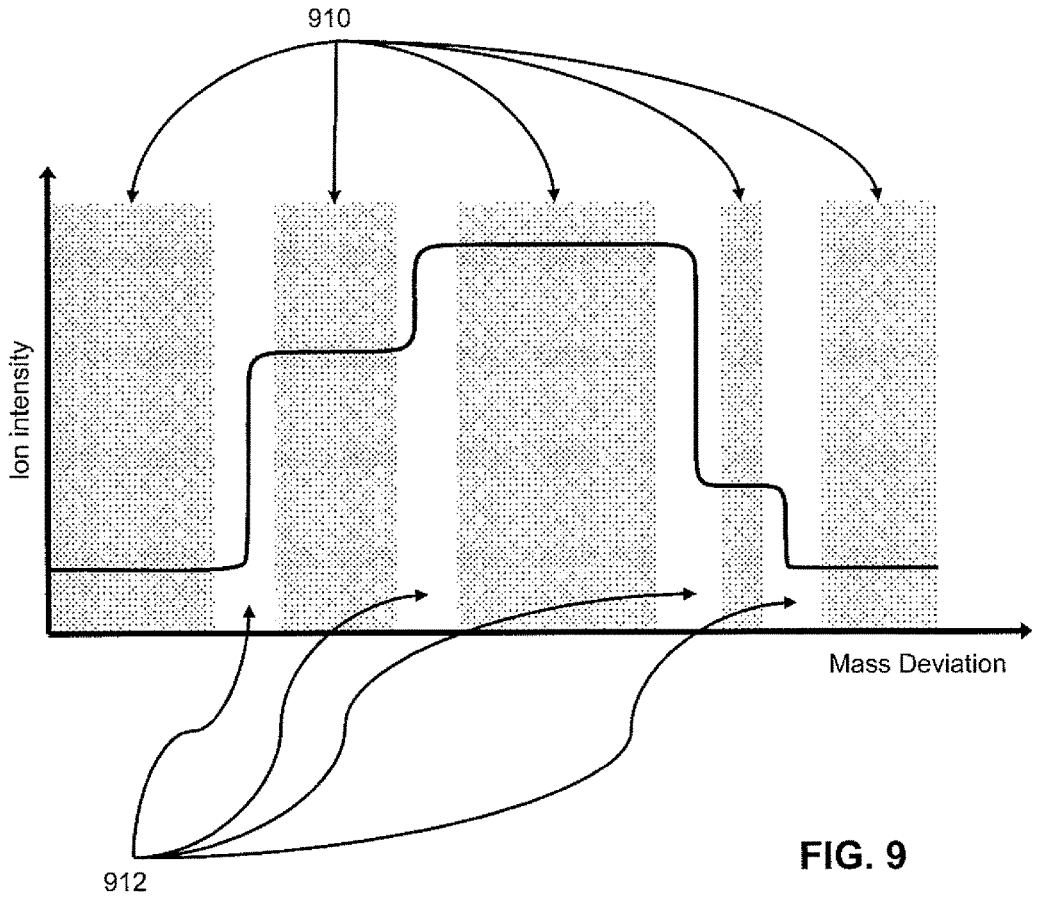
FIG. 9 is a plot showing segments of the mass spectrum in which a higher density of data points are measured.

FIG. 9 shows an example mass spectrum. In this particular example, the mass spectrum exhibits a number of plateau indicating a mass interfered spectrum of the type that would be recorded at the master Faraday detector according to the method described above with reference to FIGS. 5 to 7. The mass spectrum in FIG. 9 is split into segments or regions. Plateaus regions 910 can be assumed to be approximately flat. Slope regions 912 exhibit a rapid change the ion intensity. In the slope regions 912, a larger number (or greater density) of data points are desired per unit mass deviation in order to provide an accurate view of the mass spectrum shape.

To change the density of data points recorded at different segments of the data scan, the rate or frequency at which data points are sampled at the detectors or analysis module can be maintained as a constant, but the rate of scanning or changing of the deflection may be varied. For example, in one example the ramp rate of the field at the mass analyzer may be modified. In this case the magnetic field in the mass analyzer may be ramped more slowly in the slope segments of the mass spectrum compared to the ramp rate at the flat plateau sections of the mass spectrum. This will result is a larger number of data points per unit mass deviation in the slope segments of the scan. Alternatively, the rate of scanning or adjustment of the deflection may be modified in a different way (for example, by varying the rate at which an ion deflection unit applies a change in the deflection).

As an alternative, the frequency or rate of sampling of data points at the Faraday detectors (or at an analysis module connected to the Faraday detectors) may be varied. For example, the rate of sampling may be increased in slope sections of the mass spectrum compared to the flat plateau segments of the mass spectrum.

Obtaining Accurate Isotopic Ratios of a Mass Interfered Mass Spectrum

The method described above with reference to FIGS. 5 to 9 is particularly advantageous to obtain a precise mass spectrum for a set of interfered ions, especially to remove the effects of intensity fluctuations or drifts of the ion beam intensity over time. When the described method is used in conjunction with a number of other measurement and analysis techniques (in particular peak deconvolution), an accurate estimate of the isotopic ratios present in a sample can be achieved.

The fundamental difference of isotope ratio analysis measurements compared to trace analysis measurements is that one usually knows the exact mass of the species of interest and their peak shapes. Therefore, the major analytical task is to quantify the species, rather than to identify the species by its mass and then quantify it. In this respect, an isotope ratio analysis evaluation can be simpler, and a peak deconvolution strategy can be used to give mass peaks for the mass-interfered ions which are more precise.

Peak deconvolution can solve the problem of balancing high mass resolution requirements and ion beam transmission. Where the peak shape is captured precisely as described below (using a master detector and lead detector to measure a non-mass interfered ion peak shape) the method described here provides a powerful deconvolution algorithm where peak plateaus or full separation of species in the mass spectrum are not specifically required. The deconvolution concept relies on capturing a non-mass interfered peak shape at very high precision, as well as a high precision mass spectrum for the mass-interfered ions. Using the constraints described herein, quantitative information can be extracted from precise peak shapes for the mass-interfered ions which are determined from deconvolution of the normalized mass spectrum for the mass-interfered ions. Accordingly, the better the peak shape is initially captured, the better the quantification of the contributing mass-interfered ion species. Rather than fitting plateaus, we now fit overlays of identical peak shapes to identify the intensity of the mass-interfered ions. This technique allows measurements at larger transmission and reduced mass resolution, while still providing high precision.

Figure 10:
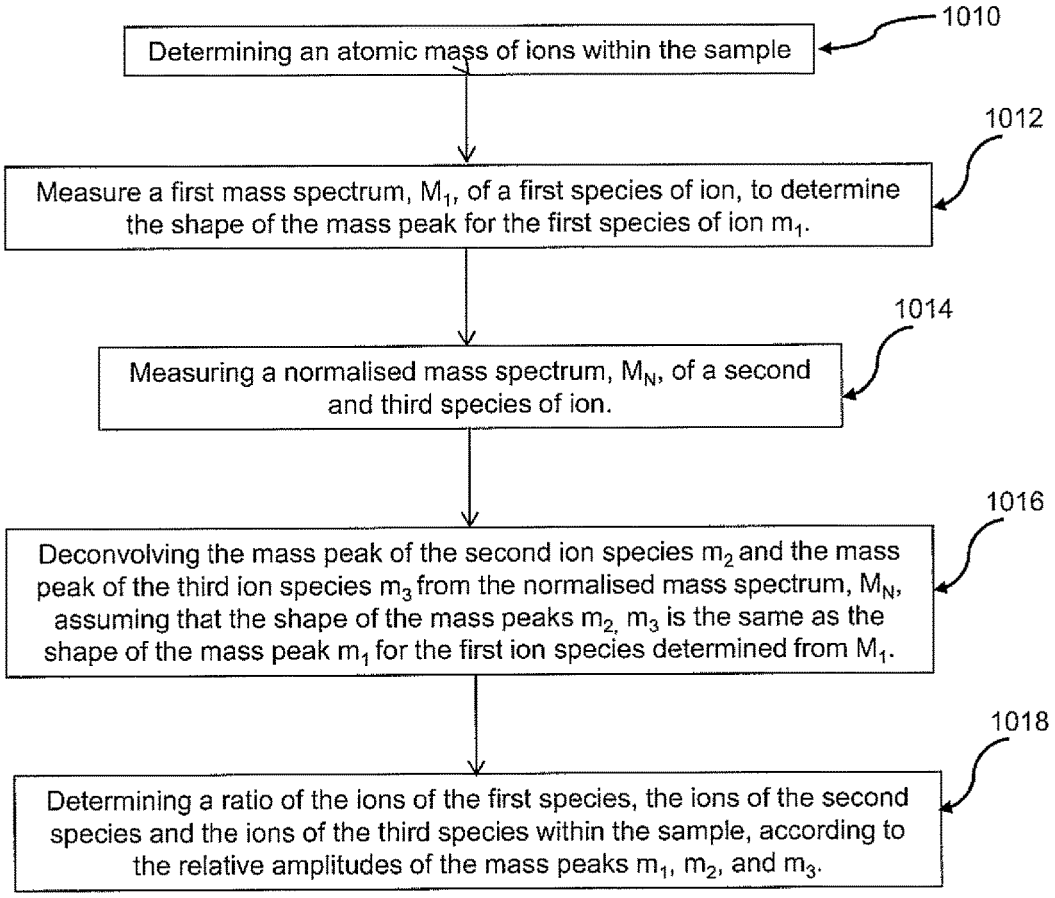
FIG. 10 is a flow diagram showing the method of determining the ratio of ion species in a sample using a multi-collector mass spectrometer.

The method for high resolution isotope ratio measurements described here includes four steps which are illustrated at FIG. 10 and listed below:

Determine the mass peak shape of an ion species not experiencing a mass interference;

Obtain a high precision measurement of the mass spectrum of mass interfered ion species;

Determine the peak shape of each mass peak within the mass interfered mass spectrum; and Perform a statistical evaluation of each peak within the mass spectrum to allow estimation of the relative abundance of the mass inferred ion species and the isotope ratios.

Each of these steps will now be discussed in more detail.

1. Determining the Mass Peak Shape of an Ion Species not Experiencing a Mass Interference (Step 1012 of FIG. 10)

A preliminary measurement of the mass spectrum of a non-interfered ion species may be measured at a detector in the detector chamber. For example, a first non-mass interfered ion species (in other words, having a mass that is different to other isotopes in the sample) may be measured at the lead detector. Simultaneously, a second non-mass-interfered ion species may be measured at the master detector. According to the method described in detail above, the scan or deflection of the second non-mass-interfered ion species may be adjusted such that the ions are scanned across the master aperture. In other words, the scan of the second ions may be adjusted so that at the beginning of the scan or deflection the second ions do not enter the master detector, then the second ions are able to enter the master detector through the master aperture, and then finally the second ions are once again prevented from entering through the master aperture. In this way, a full mass spectrum of the second ions is measured.

During the scan of the second ions, the first ions are measured at the lead detector. Ideally, the first ions will be able to enter the lead detector throughout the period of scan or deflection of the second ions, thereby providing a lead signal of maximum ion intensity. The lead signal and the master signal may subsequently be normalized. This provides a normalized mass spectrum for the second ions, from which a mass peak shape for non-mass interfered ion can be determined. Determination of a very precise mass peak shape in this way is important as it captures the peak shape independent of small fluctuations which are always present in the beams of ions.

In the example of methane described above, the $^{12}CH_4^+$ ion of mass 16 may be measured at the master detector to determine the mass peak shape. The $^{12}CH_4^+$ ion is selected as no other methane isotopes have the same nominal mass. From the determined mass spectrum, a peak shape for the interference free ion species can be resolved.

For the best results, the mass spectrum of the non-interfered ion species should be measured making use of the segmented mass scan technique discussed above. The averaged mass spectrum technique described above could also be used.

2. Measuring a High Precision Measurement of the Mass Spectrum of Mass Interfered Ion Species (Step 1014 of FIG. 10)

The mass interfered spectrum is measured according to the method described above. Therefore, the interfered mass spectrum is measured at the master Faraday detector, and then normalized against a signal obtained simultaneously at the lead Faraday detector for a non-mass interfered ion. In order to improve the precision of the obtained mass spectrum, the segmented mass scan technique and the averaged mass spectrum technique can also be applied. In this way, a very precise mass spectrum can be efficiently obtained, with reduced effects from intensity fluctuations and instability of the sample ions beam.

In the particular example of methane shown in FIG. 7, the lead Faraday detector is aligned to collect the $^{12}CH_4^+$ ion of mass 16, and the master Faraday detector is arranged to collect each of the ions of methane having a nominal mass of 17 ($^{13}CH_4^+$, $^{12}CH_3D^+$ and $^{12}CH_5^+$). Although the ion collected at the lead Faraday detector in this example is the same as the ion for which a peak shape was measured at step 2, this is not a requirement.

3. Determining the Peak Shape of Each Mass Peak Within the Interfered Mass Spectrum (Step 1016 of FIG. 10)

Here we apply the assumption that the mass peak shape of each mass interfered ion within the sample is identical to the peak shape measured at step 1 for an ion not experiencing a mass interference. The peak shape is a measure of the energy distribution of the ions within the ion beam, and of their angular momentum. In a double focusing mass spectrometer (as described above with reference to FIG. 3), all image errors caused by the energy distribution of the ions and the angular distribution of the ions are well controlled and so the peak shape can reasonably be assumed to be identical for each ion species. A similar assumption can be applied in mass spectrometers having a single focusing magnetic sector, or in other types of mass spectrometer. However, in these latter types of instrument the assumption may be less correct but still suitable.

The peak shape of each mass-interfered ion species in the mass spectrum measured at step 2 may be resolved by using deconvolution techniques. For example, mass peaks for each mass interfered ion may be fitted to the normalized mass spectrum. In this example, the fitting assumes that the shape of each mass peak for a mass-interfered ion is the same as the shape of the mass peak of the non-mass interfered ions measured in the step 1. In particular, the mass peaks for the interfering ions are fitted by adjusting the amplitude of each mass peak and/or the mass at which each mass peak occurs. In the particular example of methane shown in FIG. 7, three mass peaks can be deconvolved from the mass spectrum, one for each of the ions having a nominal mass of 17 ($^{13}CH_4^+$, $^{12}CH_3D^+$ and $^{12}CH_5^+$).

4. Perform a Statistical Evaluation of Each Peak Within the Mass Spectrum to Allow Estimation of the Isotope Ratios (Step 1018 of FIG. 10)

The isotopic ratio of the ion species present in the sample may be calculated from the mass peaks for each ion obtained according to the method described above. In particular the relative magnitude of the mass peaks may be used to calculate the relative abundance of the ion species and their isotope ratio, according to techniques known in mass spectroscopy data processing.

In a preferred example, the exact mass of the interfering ion species within the sample is known prior to beginning the measurement (step 1010 of FIG. 10). The exact mass is taken to be known according to previous measurements, as the species of ion within a sample is known (although not their abundance). For a given sample, the species of ions present and their nominal mass together with their exact mass may be known from previous study. For example, in methane (used as an example with reference to FIG. 7 above) it is well known that common isotopes include $^{12}CH_4^+$ having mass of 16, $^{13}CH_4^+$, $^{12}CH_3D^+$ and $^{12}CH_5^+$ having an mass of 17, as well as four isotopes ($^{13}CH_3D^+$, $^{13}CH_5^+$, $^{12}CH_2D_2^+$ and $^{12}CH_4D^+$) having an mass of 18.

Beneficially, where the exact mass is known, only the amplitude of each mass peak is used as a fitting parameter for deconvolution of the normalized mass spectrum as described at step 3. This allows the fitting of the mass peaks of the non-interfered ions to be less computationally intensive and more accurate.

Although in the above described method the mass peak shape of an ion species not experiencing a mass interference is determined as a first step, in another example, the mass peak shape of an ion species not experiencing a mass interference is not measured at all. Instead, the mass-interfered mass peaks are fitted to the normalized mass spectrum (as at step 3) using the peak shape a further fitting parameter. In this case, the mass peaks for the mass interfered ions may be fitted by assuming that the peak shapes are identical for each mass interfering ion. Nevertheless, deconvolving the mass peaks of the mass interfering ions from the normalized mass spectrum in this way is likely to be less straightforward than in those cases where the peak shape is known.

Many combinations, modifications, or alterations to the features of the above embodiments will be readily apparent to the skilled person and are intended to form part of the invention. Any of the features described specifically relating to one embodiment or example may be used in any other embodiment by making the appropriate changes.

For example, although the double focusing mass spectrometer in FIG. 3 is shown having an electrostatic analyzer as the first focusing sector and a magnetic mass analyzer as the second focusing sector, the mass spectrometer could be arranged in the opposite configuration, with the electrostatic and magnetic sectors in the opposite order. Moreover, a mass spectrometer having a single focusing magnetic sector could also be used.

Although in the embodiments described herein the detectors used to implement the described method are Faraday detectors, the skilled person will understand that any type of detector within the detector chamber could be used. The method described herein could equally be applied to other types of detector, for example electron multipliers or conductivity detectors. In addition, a combination of different types of detector could be used as the lead and master detector.

Furthermore, although the lead Faraday detector is described as being a moveable Faraday detector, and the master Faraday detector is described as being a fixed, center Faraday detector, any pair of Faraday detectors located in the detector chamber of the mass spectrometer could be used. The Faraday detectors could be selected from the plurality of Faraday detectors so as to provide an appropriate alignment and slit width in order to result in the scan or deflection of the ion beams as described.

Although the embodiment of FIG. 5A and FIG. 5B describes a method of adjusting the deflection of the first, second and third ion species (respectively, ions of species A, B and C) by varying the parameters of the mass analyzer (specifically, by ramping a magnetic field at the mass analyzer), the scan of ions may be accomplished in many different ways. In particular, the deflection of the ions within the sample may be varied in a number of ways. For example, the electric field within an electrostatic sector of a mass analyzer may be ramped, causing an adjustment of the deflection of all the sample ions passing through. In this way, the ions of the first species (species A) are deflected relative to the lead aperture, and the ions of the second and third species (species B and C) are fully scanned across the width of the master aperture from one side to another in a manner analogous to that described above in relation to FIG. 5A and FIG. 5B. In a further alternative, the energy of the sample ions may be ramped to cause an adjustment in the deflection of the ions. As a result, the ions of the first species (species A) can be scanned relative to the lead aperture, and the ions of the second and third species (species B and C) can be scanned relative to the master aperture, as described above for FIG. 5A and FIG. 5B.

In a particularly useful example, an ion deflection unit (also known as a pre-slit deflection unit or a pre-aperture deflection device) can be used to adjust the deflection of at least some sample ions. The ion deflection unit provides a highly controllable deflection, only to those ions passing through the unit. In one instance, an ion deflection unit can be placed in the pathway through the mass spectrometer of the ions of the second and third species (species B and C). The ion deflection unit is arranged downstream of the mass analyzer, prior to the master aperture at the entrance to the master detector. The ion deflection unit can provide a deflection to the ions of the second and third species. This deflection is in addition to any deflection applied to all the sample ions passing through the mass analyzer. Accordingly, the total deflection of the ions of the second and third species is adjusted.

Use of the ion deflection unit allows the ions of the second and third species to be scanned across the master aperture, according to the claimed invention. However, the deflection of none of the other sample ions is adjusted by the ion deflection unit. Accordingly, the deflection of the ions of the first species is not adjusted, and the "ion beam" of ions of the first species is not scanned at the lead aperture. Instead, the ions of the first species remain precisely aligned to enter through the lead aperture for detection by the lead detector throughout the period of deflection of the ions of the second and third species.

In some cases, a pre-slit ion deflection unit will be used for ions of the first species, mostly for alignment to the lead aperture. However, this pre-slit deflection unit would not necessarily be used to adjust the deflection of the ions of the first species simultaneously with the ions of the second and third species. Using ion deflection units in this way, the position of the lead and master detector may be relatively coarsely adjusted. Then, by means of the pre-slit ion deflection units, the ion beams can be positioned relative to each detector and aperture precisely to ensure best peak overlap. In another example, a pre-slit deflection unit may be used to deflect ions of the first species in such a way as to compensate for a deflection applied to all ions simultaneously (for example, by changing the magnetic field). Therefore, the pre-slit deflection unit can be used to maintain the beam of ions of the first species in a relatively stable position compared to the lead aperture.

Advantageously, use of ion deflection units enables the interfered ion species to be scanned while the non-mass interfered ions are kept stable in position. This procedure eliminates any requirement that the lead aperture is larger than the master aperture, and the slit width of lead and master aperture can be completely independent. This procedure further eliminates any need to scan the magnet or the electric field of at the mass analyzer, or to scan the ion beam energy.

Use of a pre-slit ion deflection unit prior to the master aperture will be significant technical advantages. For example, the lead signal is fixed in position and so that there is less need for the lead detector signal to be free of interferences. The lead signal is used to normalize of the master signal, which requires that the lead signal always reflects the fluctuations inside the ion source. The lead signal should not be complicated by a peak structure due to mass interference of different ion species. Ideally, the measured lead signal will be perfectly flat and will not show any structure due to peak overlays of different ion species at the master detector. This achieved in the case that the ion beam position of the non-mass interfered species is held in a stable position, while the mass-interfered ion species at the master detector are scanned across the master aperture to capture the full structure of the mass-interfered spectrum. Referencing of the master signal to the lead signal always guarantees normalization in order to cancel of drift effects which would otherwise distort the peak shapes measured at the master detector.

Scanning the deflection using the pre-slit ion deflection units also allows in micro-scans which can be performed rapidly and may be useful for configuration purposes. Furthermore, micro-scans using the pre-slit ion deflection units also can use a segmented scan procedure. This way, the micro-scans provide a higher density of measurement points where the mass interferences overlap on the rising and falling edges of the mass spectrum, while recording fewer points in the plateau region of the mass spectrum.

It is noted that when using the ion deflection unit to adjust the deflection of ions of species B and C, the measurement otherwise proceeds according to the method and apparatus described in relation to FIG. 5A and FIG. 5B.

In a further example, the scan of ions can be accomplished by changing the position of the aperture, and preferably the detector. For instance, the scan of ions of the second and third species at the master detector can result from the movement of the master aperture and master detector relative to the ions beam containing ions of the second and third species. In this way, the ion beam can remain unmoved, but the aperture can be moved such that ions of the second but not the third species, then both the second and the third species, and then the third but not the second species are received through the master aperture into the master detector. The position and movement of the aperture and detectors can be controlled by the controller of the mass spectrometer to a high resolution.

In a still further example, a combination of the methods for deflection of the ions may be used, and this may also be implemented in combination with movement of the master and/or lead detector. For example, these methods for scanning the ions may be employed together with a change of magnification of the instrument using a zoom lens. In this way, the beam that hits the lead detector may be "held in place" while other ion beams are scanned over one or more master detectors.

Although in the text only analysis of two mass interfering species at the master detector is discussed, there can be many mass interfering ions in a single sample. For example, here can easily be five or more mass-interfering species within one mass spectrum, complicating the mathematical problem for deconvolution of the mass peaks. Nevertheless, the above method can still be applied as described. The number of interferences on one peak can easily reach up to thirty species in cases of complex samples. The method described herein is particularly advantageous for such complex mass spectra.

Furthermore, in some cases multiple mass-interfered spectra may be measured at the same time by defining one or more master detectors. For example, a first mass interfered ion beams may be measured at a first master detector, and a different, spatially separated mass interfered ion beam may be measured at a second master detector. The signal recorded at each master detector may then be normalized with respect to the simultaneously recorded lead signal.

The invention claimed is:

1. A method for generating a mass spectrum of sample ions using a multi-collector mass spectrometer, the mass spectrometer including a spatially dispersive mass analyzer to direct the sample ions into a detector chamber, the method comprising:

(a) generating sample ions of a first ion species A having a mass to charge ratio $(m/z)_A$, a second ion species B having a mass to charge ratio $(m/z)_B$, and a third ion species C having a mass to charge ratio $(m/z)_C$, wherein the ions of species A have a different nominal mass to the ions of species B and C, and further wherein the ions of species B have the same nominal mass as the ions of species C;

(b) directing the sample ions of the species A, B and C to travel through the mass analyzer and towards detectors in the detector chamber, the sample ions being deflected during their travel;

(c) scanning the ions of species B and C across a master aperture defined in a master mask of a master detector, while the ions of species A pass through a lead aperture defined in a lead mask of a lead detector; and (d) generating a lead signal representing the ion intensity received at the lead detector from the ions of species A, and generating a master signal representing the ion intensity received at the master detector while the ions of species B and C are scanned across the master aperture;

wherein, during scanning, ions of the species A are detected by the lead detector while ions of the species B but not C, then both species B and species C, and then species C but not B are detected by the master detector.

2. The method according to claim 1, further comprising (e) normalizing the master signal from the ions B and the ions C using the lead signal to determine a normalized mass spectrum of the ions B and the ions C.

3. The method according to claim 1, wherein one or both of the lead detector and master detector is an ion counting detector.

4. The method according to claim 1, wherein one or both of the lead detector and master detector is a Faraday detector.

5. The method according to claim 1, wherein while the ions of species B and C are scanned across the master aperture, the method further comprises scanning the ions of species A across at least a portion of the lead aperture of the lead mask of the lead detector.

6. The method according to claim 1, wherein the lead aperture is wider than the master aperture.

7. The method according to claim 1, wherein the lead aperture and master aperture have same width.

8. The method according to claim 1, wherein a lead pre-aperture deflection unit located downstream of the mass analyzer and in front of the lead aperture deflects the ion species A such that the ion species A fully passes through the lead aperture while the ions of species B and C are scanned across the master aperture.

9. The method according to claim 1, wherein for all times when at least one of the ion species B and C is being collected by the master detector, ions of the species A are passing through the lead aperture and are collected by the lead detector.

10. The method according to claim 1, wherein scanning the ions of species B and C comprises adjusting the deflection of ions of species B and C during their travel through the mass analyzer and towards detectors in the detector chamber.

11. The method according to claim 1, wherein the ion species B and C are scanned across the master aperture by changing a deflection caused by a master pre-aperture deflection unit located downstream of the mass analyzer and in front of the master aperture.

12. The method according to claim 11, wherein the deflection of ion species A is not changed while the deflection of ion species B and C is changed using the master pre-aperture deflection unit.

13. The method according to claim 1, wherein the ion species B and Care scanned across the master aperture by ramping a magnetic field at the mass analyzer.

14. The method according to claim 1, wherein the ion species B and Care scanned across the master aperture by adjusting an electric field at an electrostatic sector of the mass analyzer.

15. The method according to claim 1, wherein the ion species B and C are scanned across the master aperture by changing a deflection by adjusting an energy of the sample ions.

16. The method according to claim 1, wherein the ion species B and C are scanned across the master aperture by moving the master aperture.

17. The method according to claim 1, wherein the ions of species A comprise a first species of atomic isotope, the ions of species B comprise a second species of atomic isotope and the ions of species C comprise a species of molecular isotope.

18. The method according to claim 1, wherein the ions of species A comprise a first species of molecular isotope, the ions of species B comprise a second species of molecular isotope and the ions of species C comprise a third species of molecular isotope.

19. The method according to claim 1, wherein the method further comprises positioning the lead detector within the detector chamber to receive the ions of species A.

20. The method according to claim 1, wherein the method further comprises positioning the master detector within the detector chamber to receive the ions of species B and the ions of species C.

21. The method according to claim 1, wherein the mass spectrometer comprises a plurality of detectors in the detector chamber, each detector comprising a mask defining an aperture, the method further comprising:

selecting the lead detector and/or the master detector from the plurality of detectors to select a width of the lead and/or master apertures respectively.

22. The method according to claim 2, wherein determining a normalized mass spectrum of the ions B and the ions C comprises dividing the master signal at a given point in time by the lead signal acquired at the same point in time.

23. The method according to claim 2, wherein the normalized mass spectrum of the ions of species B and ions of species C is a first normalized mass spectrum, the method further comprising:

generating a second normalized mass spectrum; and determining an average normalized mass spectrum from an average of the first and second normalized mass spectrum.

24. The method according to claim 1, further comprising changing the rate of adjusting the deflection so as to scan the ions of species A and/or B and C at a plurality of different scan rates as they are scanned across the respective lead and/or master apertures.

25. Apparatus for generating a mass spectrum of sample ions using a multi-collector mass spectrometer containing a spatially dispersive mass analyzer, the sample ions being directed to travel through the mass analyzer and towards detectors in a detector chamber wherein the sample ions are deflected during their travel, the mass spectrometer including a lead detector arranged in the detector chamber to receive sample ions of a first ion species A having a mass to charge ratio $(m/z)_A$, and a master detector arranged in the detector chamber to receive sample ions of a second ion species B having a mass to charge ratio $(m/z)_B$ and a third ion species C having a mass to charge ratio $(m/z)_C$, and wherein the ions of species A have a different nominal mass to the ions of species B and C, and further wherein the ions of species B have the same nominal mass as the ions of species C, the apparatus comprising:

a control module configured to scan the ion species B and C across a master aperture defined in a master mask of the master detector, while the ions of species A pass through a lead aperture defined in a lead mask of a lead detector; and an analysis module configured to:

receive a lead signal generated at the lead detector, the lead signal representing the ion intensity received at the lead detector from the ions of species A, while the ions of species B and C are scanned across the master aperture; and receive a master signal generated at the master detector, the master signal representing the ion intensity received at the master detector while the ions of species B and C are scanned across the master aperture;

wherein the control module is configured such that, during scanning, ions of the species A are detected by the lead detector while ions of the species B but not C, then both species B and C, and then species C but not B are detected by the master detector.

26. The apparatus according to claim 25, wherein the analysis module is further configured to normalize the master signal from the ions B and C using the lead signal to determine a normalized mass spectrum of the ions B and the ions C.

27. The apparatus according to claim 25, wherein one or both of the lead detector and master detector is a Faraday detector.

28. The apparatus according to claim 25, wherein the lead aperture is wider than the master aperture.

29. The apparatus according to claim 25, wherein the control module is configured to scan the ions of species B and C across the master aperture by changing a deflection caused by a master pre-aperture ion deflection unit located downstream of the mass analyzer and in front of the master aperture.

30. The apparatus according to claim 29, wherein the deflection of ion species A is not changed while the deflection of ion species B and C is changed using the master pre-aperture ion deflection unit.

31. The apparatus according to claim 25, wherein the ions of species A comprise a first species of atomic isotope, the ions of species B comprise a second species of atomic isotope and the ions of species C comprise a species of molecular isotope.

32. The apparatus according to claim 25, wherein the ions of species A comprise a first species of molecular isotope, the ions of species B comprise a second species of molecular isotope and the ions of species C comprise a third species of molecular isotope.

33. The apparatus according to claim 25, wherein the lead detector is movable, and the control module is further configured to position the lead detector within the detector chamber to receive the ions of species A.

34. The apparatus according to claim 25, wherein the master detector is movable, and the control module is further configured to position the master detector within the detector chamber to receive the ions of species B and the ions of species C.

35. The apparatus according to claim 25, wherein the mass spectrometer comprises a plurality of detectors in the detector chamber, each detector including a mask defining an aperture, and the control module is further configured to select the lead detector and/or the master detector from the plurality of detectors to select a size of the said lead and/or master aperture respectively.

36. The apparatus according to claim 26, wherein the analysis module is configured to determine the normalized mass spectrum of the ions B and the ions C by dividing the master signal at a given point in time by the lead signal acquired at the same point in time.

37. A method for determining the abundance of ion species in a sample using a multi-collector mass spectrometer, the mass spectrometer comprising a spatially dispersive mass analyzer to direct the sample ions into a detector chamber, wherein the sample comprises sample ions of a first ion species A having a mass to charge ratio $(m/z)_A$, ions of a second ion species B having a mass to charge ratio $(m/z)_B$, and ions of a third ion species C having a mass to charge ratio $(m/z)_C$, wherein the ions of species A have a different nominal mass to the ions of species B and the ions of species C and ions of species A do not mass interfere with any other ion species, and further wherein the ions of species B have the same nominal mass as the ions of species C, the method comprising:

(a) directing the sample ions of the species A, B and C to travel through the mass analyzer and towards detectors in the detector chamber, the sample ions being deflected during their travel;

(b) scanning the ions of species B and C across a master aperture defined in a master mask of a master detector, while the ions of species A pass through a lead aperture defined in a lead mask of a lead detector;

(c) generating a lead signal representing the ion intensity received at the lead detector from the ions of species A, and generating a master signal representing the ion intensity received at the master detector while the ions of species B and C are scanned across the master aperture;

(d) normalizing the master signal from the ions B and the ions C using the lead signal to determine a normalized mass spectrum of the ions B and the ions C;

(e) deconvolving a mass peak of each of the ions of species B and of species C from the normalized mass spectrum, according to the assumption that the shape of the mass peak of the ions of species B is the same as the shape of the mass peak of the ions of species C; and (f) determining an abundance of the ions of species A, the ions of species B and/or the ions of species C within the sample from the mass peaks.

38. The method according to claim 37, wherein deconvolving a mass peak for each of the ions of species B and of species C at (b) further comprises:

fitting to the normalized mass spectrum a mass peak of ion species B and a mass peak of ion species C, wherein the shape of the mass peak of ion species B and the shape of the mass peak of ion species C are the same as the shape of the mass peak of the ions of species A or of the other non-mass interfering species;

wherein the mass peak for ion species B and for ion species C is fitted by adjusting the amplitude of each mass peak and/or the mass at which each mass peak occurs.

39. The method according to claim 37, further comprising using the determined abundances for determining one or more abundance ratios, the ratios determined according to relative amplitudes of the deconvolved mass peaks of at least two of the ions of species A, the ions of species B and the ions of species C.

40. The method according to claim 37, wherein the sample ions further comprise ions of one or more further ion species, wherein the ions of each of the one or more further ion species have the same nominal mass as the ions of species B and species C; and further comprising deconvolving a mass peak of each of the ions of species B, species C and each of the one or more further ion species from the normalized mass spectrum, according to the assumption that the shape of the mass peak of the ions of species B, species C and each of the one or more further ion species is the same.

* * * * *